US005451713A

United States Patent [19]

Suzuki et al.

[11] Patent Number: 5,451,713

[45] Date of Patent: Sep. 19, 1995

[54] DEVELOPING APPARATUS USING A DEVELOPER CARRIER CAPABLE OF FORMING MICROFIELDS

[75] Inventors: Koji Suzuki, Yokohama; Shigekazu Enoki, Kawasaki; Hiroshi Takashima, Yono; Naoki Iwata, Tokyo; Yuichi Ueno, Kawasaki, all of Japan

[73] Assignee: Ricoh Company, Ltd., Tokyo, Japan

[21] Appl. No.: 242,438

[22] Filed: May 13, 1994

Related U.S. Application Data

[63] Continuation of Ser. No. 874,216, Apr. 27, 1992, Pat. No. 5,315,061, which is a continuation of Ser. No. 597,881, Oct. 12, 1990, abandoned.

[30] Foreign Application Priority Data

| | | | |
|---|---|---|---|
| Oct. 13, 1989 | [JP] | Japan | 1-267763 |
| Jan. 26, 1990 | [JP] | Japan | 2-15110 |
| Apr. 2, 1990 | [JP] | Japan | 2-84992 |
| Apr. 5, 1990 | [JP] | Japan | 2-91088 |

[51] Int. Cl.[6] ..... G03G 15/06

[52] U.S. Cl. ..... 118/651; 355/261

[58] Field of Search ..... 355/245, 259, 261, 262; 118/647, 648, 651, 661; 492/38

[56] References Cited

U.S. PATENT DOCUMENTS

| | | | |
|---|---|---|---|
| 3,203,394 | 8/1965 | Hope et al. | 118/653 X |
| 3,284,224 | 11/1966 | Lehmann | 355/259 X |
| 3,696,783 | 10/1972 | Fantuzzo | 118/637 |
| 3,999,515 | 12/1976 | Weiler | 118/651 |
| 4,282,303 | 8/1981 | Bergen | 430/120 |
| 4,295,443 | 10/1981 | Kohyama | 118/657 |
| 4,425,382 | 1/1984 | Tajima | 118/657 |
| 4,538,898 | 9/1985 | Kanno et al. | 118/657 |
| 4,561,381 | 12/1985 | Kaneko et al. | 118/652 |
| 4,564,285 | 1/1986 | Yasuda et al. | 118/651 |
| 4,576,463 | 3/1986 | Sakamoto et al. | 355/259 X |
| 4,656,964 | 4/1987 | Kanno et al. | 118/651 X |
| 4,696,255 | 9/1987 | Yano et al. | 118/653 |
| 4,788,570 | 11/1988 | Ogata et al. | 355/245 |
| 4,896,625 | 1/1990 | Sakamoto et al. | 118/657 |
| 4,982,692 | 1/1991 | Uematsu | 118/661 |
| 5,172,169 | 12/1992 | Takashima et al. | 355/246 |
| 5,220,383 | 6/1993 | Enoki et al. | 355/246 |
| 5,239,344 | 8/1993 | Enoki et al. | 355/259 |
| 5,245,391 | 9/1993 | Suzuki et al. | 355/246 |
| 5,311,263 | 5/1994 | Suzuki et al. | 355/251 |
| 5,315,061 | 5/1994 | Suzuki et al. | 118/651 |
| 5,339,141 | 8/1994 | Suzuki et al. | 355/246 |

FOREIGN PATENT DOCUMENTS

| | | |
|---|---|---|
| 2299669 | 8/1976 | France . |
| 0036245 | 4/1978 | Japan . |
| 0211172 | 12/1983 | Japan . |
| 0053973 | 3/1985 | Japan . |
| 0214874 | 8/1990 | Japan . |
| 1385966 | 2/1972 | United Kingdom . |
| 1573375 | 6/1977 | United Kingdom . |

*Primary Examiner*—Robert B. Beatty

*Attorney, Agent, or Firm*—Oblon, Spivak, McClelland, Maier & Neustadt

[57] ABSTRACT

A developing device develops a latent image electrostatically formed on an image carrier in a developing region to produce a corresponding visible image. The developing device includes a rotatable developer carrier for carrying a developer to the developing region and a charging device for forming small closed electric fields in the vicinity of the surface of the developer carrier. The developer is deposited on the surface of the developer carrier by the small closed electric fields. The developer carrier comprises a conductive base and dielectric bodies fixedly buried in recesses formed in the conductive base with each of the dielectric bodies having a predetermined cross-section which extends in a direction of a line normal to the surface of the developer carrier. Also, the developer carrier has a photoconductive surface which is charged by a charging device and selectively illuminated by an illuminating device to deposit a charge on the photoconductive surface which forms a great number of microfields on the photoconductive surface.

27 Claims, 24 Drawing Sheets

FIG. 11A
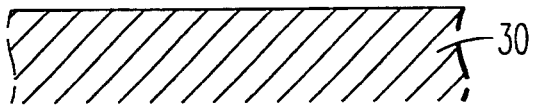
FIG. 11B
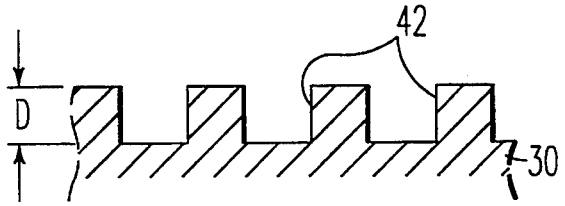
FIG. 11C
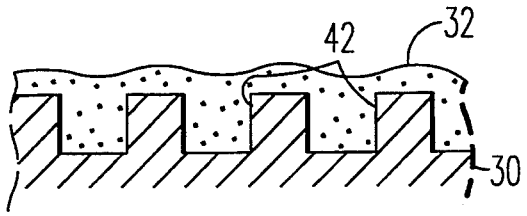
FIG. 11D
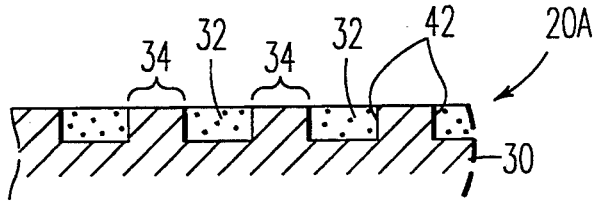
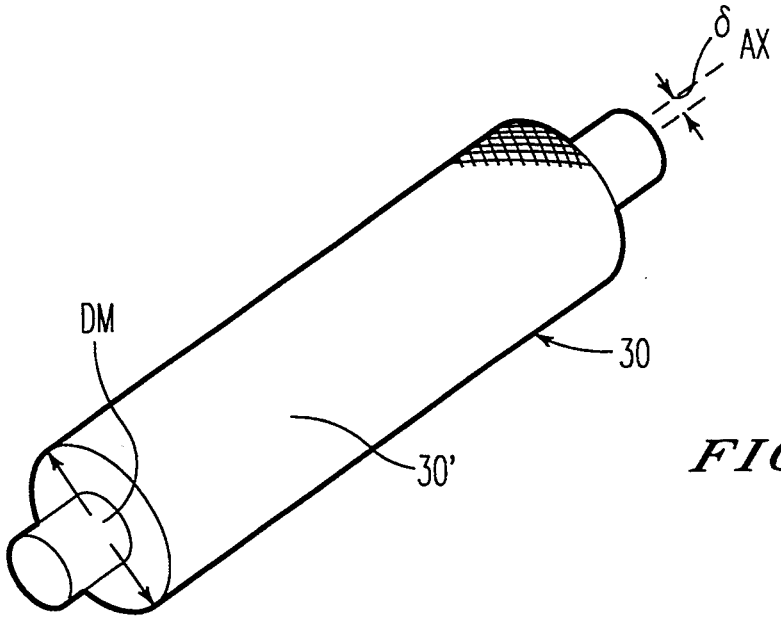
FIG. 12A

DEVELOPING APPARATUS USING A DEVELOPER CARRIER CAPABLE OF FORMING MICROFIELDS

This is a continuation of application Ser. No. 07/874,216, filed on Apr. 27, 1992, now U.S. Pat. No. 5,315,061, which is a continuation of Ser. No. 07/597,881, filed Oct. 12, 1990, abandoned.

BACKGROUND OF THE INVENTION

The present invention relates to a developing method and an apparatus therefor of the type causing a developer carrier to carry and transport a one-component developer to a developing region where the developer carrier faces an image carrier so as to develop a latent image electrostatially formed on the image carrier. More particularly, the present invention relates to a developing method and an apparatus therefor which develops a latent image by use of a developer carrier capable of forming microfields thereon.

A developing device of the type using a powdery dry developer is extensively used with an electrophotographic copier, laser beam printer, facsimile transceiver or similar electrophotographic image forming equipment which electrostatically forms a latent image on an image carrier such as a photoconductive element and develops it by a developer. The powdery developer is available as a two-component developer which is the mixture of a toner and a carrier or a one-component developer which does not contain a carrier. Although a developing device using the two-component developer reproduces attractive images relatively stably, the carrier is apt to deteriorate and the mixture ratio of the toner and carrier is apt to change. This results in troublesome management of the apparatus and a bulky construction. For this reason, a developing device which uses the one-component developer free from the above problem is attracting much attention. The one-component developer is implemented with the toner only or with the toner and an auxiliary agent for controlling the polarity and amount of charge. The toner in turn is implemented as a magnetic toner containing magnetic power therein or a nonmagnetic toner which does not contain it. Since a magnetic body is usually opaque, color image, whether it be full-color or multicolor, developed by the magnetic toner does not appear sharp. Therefore, it is preferable to use the one-component developer constituted by the non-magnetic toner when it comes to color images.

In a developing device implemented with a one-component developer, a developing roller or similar developer carrier carries the developer thereon and transports it to a developing region where the developer carrier faces an image carrier. In this region, the developer develops a latent image electrostatically formed on the image carrier. A prerequisite with this type of developing device is that a great amount of sufficiently charged toner being fed to the developing region in order to insure high quality images having predetermined density. When the magnetic toner is used, a sufficient amount of one-component developer may be deposited on the surface of the developer carrier by magnets. However, the non-magnetic one-component developer is immune to magnetism, so that transporting a great amount of developer to the developing region is difficult.

Various implementations have been proposed in the past for eliminating the above problem. For example, a developing device disclosed in Japanese Patent Laid-Open Publication No. 43767/1986 has a developer carrier covered with an insulative dielectric layer, and a sponge roller or similar developer supply member held in pressing contact with the dielectric layer. The developer carrier and the sponge roller are charged to opposite polarities by friction. A non-magnetic one-component developer charged to the opposite polarity to the dielectric layer is electrostatically deposited on the dielectric layer and transported to a developing region. A drawback with this scheme is that the electric field developed in the vicinity of the surface of the dielectric layer is not intense enough to deposit a great amount of toner on the surface of the developer carrier and, therefore, the developer available in the developing region is short. In this condition, forming a developed image or toner image with high density is not easy. To eliminate this drawback, the developer carrier is moved at a speed twice or more higher than the moving speed of the image carrier. This, however, brings about another problem that the density of a solid image formed on the image carrier becomes unusually high in a trailing edge portion of the image with respect to the moving direction of the image carrier, resulting in poor image quality.

Another conventional developing device generates an electric field between the developer carrier and the image carrier in a direction for electrostatically transferring the non-magnetic one-component developer toward the developer carrier. Such an approach, however, also fails to deposit a sufficient amount of developer on the developer carrier.

Japanese Patent Laid-Open Publication No. 51841/1979 teaches another approach which uses a developer supply member for positively causing the non-magnetic developer to electrostatically deposit on the developer carrier. Specifically, after the developer carrier has moved away from the developing region, the non-magnetic one-component developer remaining thereon is scraped off. Then, the surface layer of the developer carrier is applied with a charge by corona discharge. The developer supply member positively and electrostatically deposits the non-magnetic developer on the charged surface of the developer carrier. With this approach, it is impossible to increase the amount of developer carried on the developer carrier and, therefore, to feed a great amount of toner to the developing region.

The developer carrier may be provided with undulations on the surface thereof so as to fill them with the non-magnetic one-component developer, as disclosed in Japanese Patent Laid-Open Publication No. 53996/1985. While such a configuration may be successful in increasing the amount of developer to reach the developing region, such a developer contains a substantial amount of toner whose charge is short and, therefore, cannot produce high quality images.

Further, Japanese Patent Publication No. 9711/1980 proposes a developing device having a developer carrier made up of a conductive support member, an insulating layer provided on the support member, and a conductive lattice member provided on the insulating member. The insulating layer is exposed to the outside through numerous openings formed through the lattice member. A voltage opposite in polarity to a developer is applied between the lattice member and the support member to generate microfields, so that a great amount of developer may be deposited on the surface of the developer carrier by the microfields. However, such microfields are not attainable without resorting at least an exclusive external power source, resulting in a complicated construction. Other approaches for generating microfields are taught in U.S. Pat. Nos. 3,739,748 (Rittler et al), 3,645,618 (Lancia et al), 3,759,222 (Maksymiak et al), and "Microfield Donors for Touchdown Development" by P. G. Andrus et al, SPSE 2nd International Conference on Electrophotography, October 1973.

SUMMARY OF THE INVENTION

It is therefore an object of the present invention to provide a developing method and an apparatus therefor capable of depositing a great amount of one-component developer on a developer carrier by use of numerous microfields and causing the developer carrier to transport it to a developing region for developing a latent image electrostatically formed on an image carrier.

It is another object of the present invention to provide a developing device and an apparatus therefor developing an electrostatic latent image on an image carrier by use of a developer carrier which can form numerous microfields thereon, thereby producing an image with faithful tones.

In one aspect of the present invention, in a developer carrier for carrying a developer on the surface thereof which is constituted by at least two members each having a particular characteristic, at least one of the two members is arranged in fragments, and at least one of the two members having a charge retaining function, whereby a great number of electric fields are developed between the two members.

In another aspect of the present invention, a developer carrier for carrying a developer on the surface thereof on which a great number of microfields are to be developed comprises a conductive base, and a dielectric body having surface portions which are exposed on the surface of the conductive base and arranged in a predetermined pattern together with conductive portions which form a part of the base, whereby microfields are developed between nearby ones of the conductive portions of the base and the surface portions of the dielectric body.

In another aspect of the present invention, a developer carrier for carrying a developer on the surface thereof on which a great number of microfields are to be developed comprises a conductive base, and a resistance body constituting the surface and comprising medium resistance bodies having a higher resistivity than the base and high resistance bodies having a higher resistivity than the medium resistance bodies, whereby the microfields are developed between nearby ones of the high resistance bodies and medium resistance bodies.

In another aspect of the present invention, in a developer carrier for carrying a developer on the surface of a member at least a part of which has a charge retaining function, when a charge is selectively deposited on the surface of the member to define a plurality of portions each having a particular charge, a great number of electric fields are developed between nearby ones of the plurality of portions.

In another aspect of the present invention, a developer carrier for carrying a developer on the surface thereof on which a great number of microfields are to be developed comprises a conductive base, and a charge retaining member provided on the surface of the base and having a charge retaining function, a great number of microfields being developed, when a charge is selectively deposited on the surface of the charge retaining member to define a plurality of portions each having a particular charge condition, between nearby ones of the plurality of portions.

In another aspect of the present invention, a developing device for developing a latent image electrostatically formed on an image carrier by supplying a developer to a developing region of the image carrier comprises a developer carrier comprising a conductive base, and a dielectric body having surface portions exposed on the surface of the base in a predetermined pattern together with conductive portions which form a part of the base, microfields being developed between nearby ones of the conductive portions of the base and the surface portions of the dielectric body, and a charging member for charging the developer carrier to deposit a developer on the surface of the developer carrier.

In another aspect of the present invention, a developing device for developing a latent image electrostatically formed on an image carrier by supplying a developer to a developing region of the image carrier comprises a developer carrier comprising a conductive base, and a resistance body made up of medium resistance bodies having a higher resistivity than the base and high resistance bodies having a higher resistivity than the medium resistance bodies for forming microfields between nearby ones of the high resistance bodies and medium resistance bodies, and a charging member for charging at least the high resistance bodies of the medium and high resistance bodies to a predetermined polarity to form the microfields on the basis of a difference between surface potentials, thereby depositing the developer on the surface of the developer carrier.

In still another aspect of the present invention, a developing device for developing a latent image electrostatically formed on an image carrier by supplying a developer to a developing region of the image carrier comprises a developer carrier having a photoconductive surface, charging member for charging the photoconductive surface of the developer carrier, and an illuminating device for selectively illuminating the photoconductive surface of the developer carrier having been charged by the charging member to define illuminated portions and non-illuminated portions on the photoconductive surface, thereby forming microfields between nearby ones of the illuminated and non-illuminated portions.

In a further aspect of the present invention, a developing device for developing a latent image electrostatically formed on an image carrier by supplying a developer to a developing region of the image carrier comprises a developer carrier provided on the surface of a dielectric body having a charge retaining function, and a charging member for forming, when a charge is selectively deposited on the surface of the dielectric body to define a plurality of portions each having a particular charge, a great number of microfields between nearby ones of the plurality of portions.

BRIEF DESCRIPTION OF THE DRAWINGS

The above and other objects, features and advantages of the present invention will become more apparent from the following detailed description taken with the accompanying drawings in which:

FIGS. 11A to 11D are views demonstrating a specific procedure for fabricating the modified developing roller;

FIG. 12A is an external perspective view of a conductive base of the modified developing roller;

DESCRIPTION OF THE PREFERRED EMBODIMENTS

Preferred embodiments of the present invention will be described hereinafter which are implemented as a developing device of an electrophotographic copier belonging to a family of image forming equipment.

First Embodiment

Figure 1:
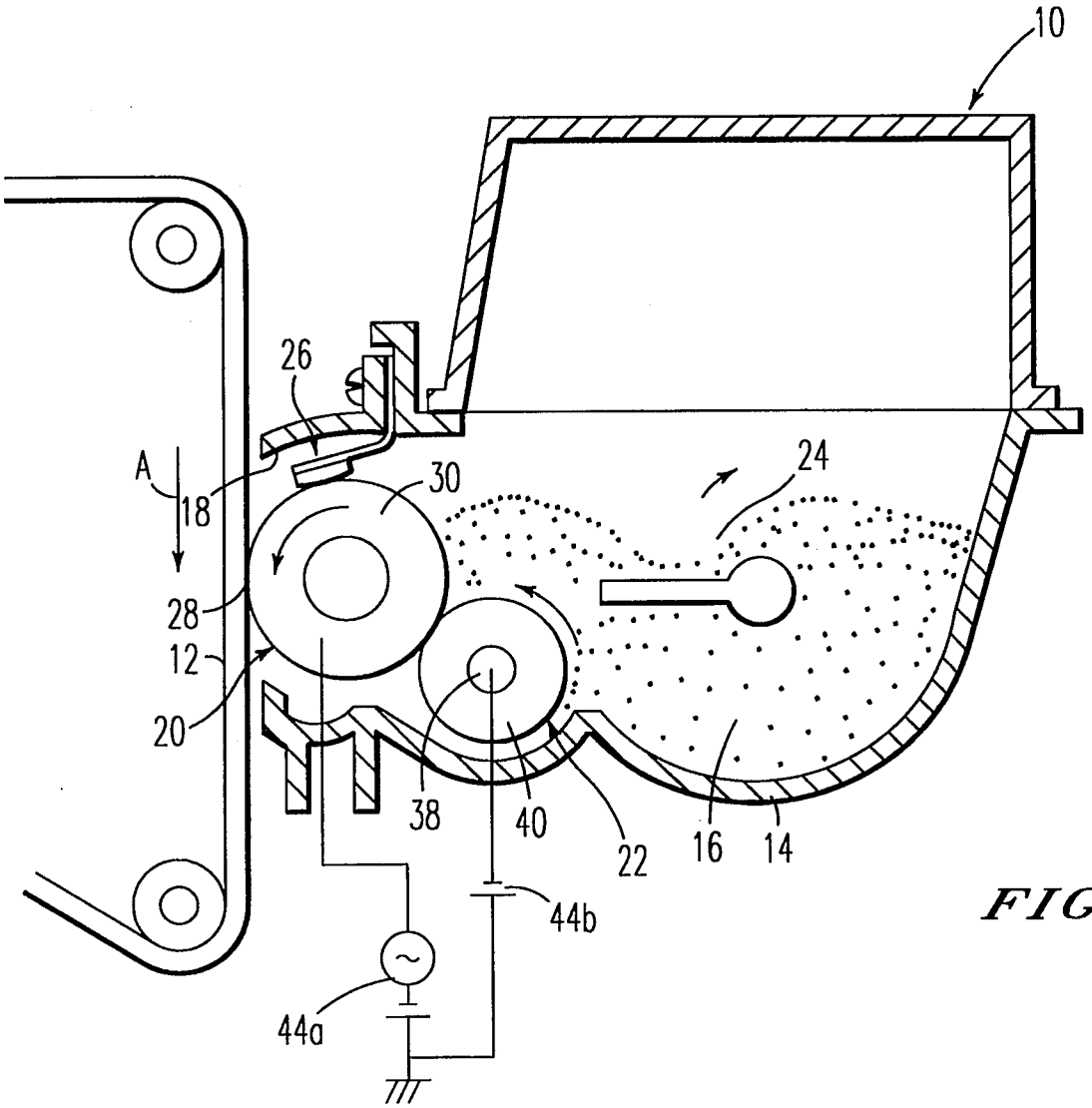
FIG. 1 is a section showing a first embodiment of the developing device in accordance with the present invention.
Figure 2:
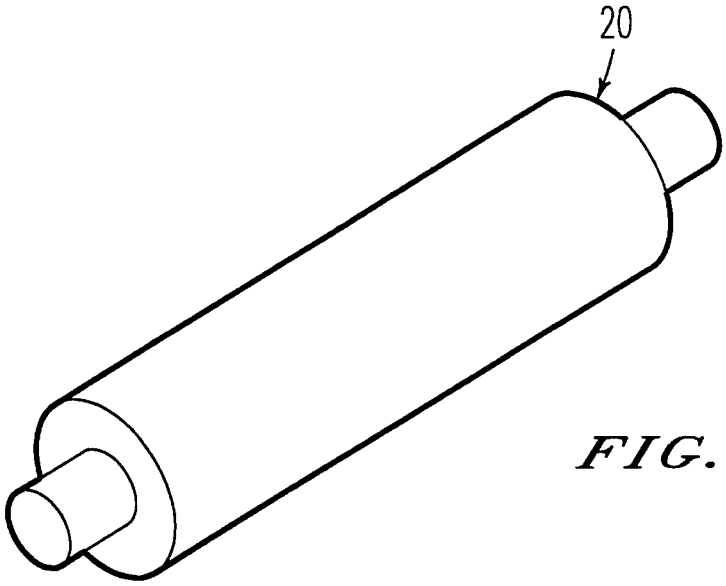
FIG. 2 is an external perspective view of a developing roller included in the embodiment.

Referring to FIG. 1 of the drawings, a developing device embodying the present invention is shown and generally designated by the reference numeral 10. The developing device 10 is located to face an image carrier in the form of a photoconductive belt 12 which is movable in a direction shown by reference numeral 4. The developing device 10 has a casing 14 which stores therein a one-component developer, or non-magnetic toner, 16. The developer 16 may or may not contain an auxiliary agent for controling the polarity and amount of charge. The toner is usually a polyester-, BMA-, polystylene-, expoxy-, phenol- or similar resin-based composition. The specific volume resistivity of the toner ranges from about $10^7$ to $10^{12}$ Ω·cm, and this is also true with the other embodiments which will be described. A developing roller 20 is supported by a front and a rear walls, not shown, of the casing 14 and partly exposed to the outside through an opening 18 which is formed through the casing 14. The roller 20 faces the belt 12 and is rotatable counterclockwise as viewed in the figure and at a speed of 100 r.p.m, for example. FIG. 2 shows the roller 20 in a perspective view. The roller 20 is a mere example of a developer carrier and may be implemented as a belt, if desired. A toner supply roller 22 is also supported by the opposite side walls of the casing 14 and serves as a developer supply member. The toner supply roller 22 is rotated counterclockwise at a speed of, for example, 70 r.p.m in contact with the developing roller 20.

An agitator 24 is disposed in the casing 14 and rotated clockwise as viewed in FIG. 1 to agitate the toner 16 accommodated in the casing 14. In this configuration, the toner 16 is fed to the toner supply roller 22 while being agitated by the agitator 24. The toner supply roller 22 in turn conveys the developer 16 to the developing roller 20. During such transition, the toner 16 is charged by friction to a predetermined polarity, i.e., positive polarity opposite to the polarity of an electrostatic latent image in the illustrative embodiment. As a result, the toner 16 is electrostatically deposited on the periphery of the developing roller 20. This part of the construction and operation will be described specifically later. While the developing roller 20 transports the toner 16 deposited thereon, a doctor blade 26 regulates the toner 16 to a predetermined thickness. In this sense, the doctor blade 26 plays the role of a layer thickness regulating member. The toner 16 so regulated in thickness enters a developing region 28 where the developing roller 20 faces the belt 12. In this region 28, the toner is electrostatically transferred from the roller 20 to the belt 12 to develop a latent image which has been electrostatically formed on the belt 12. A part of the toner 16 having moved away from the developing region 28 without being transferred to the latent image is returned by the developing roller 20 to the toner supply roller 22. The developed image, or toner image, on the belt 12 is transferred therefrom to a paper sheet, not shown, and then fixed.

Figure 3:
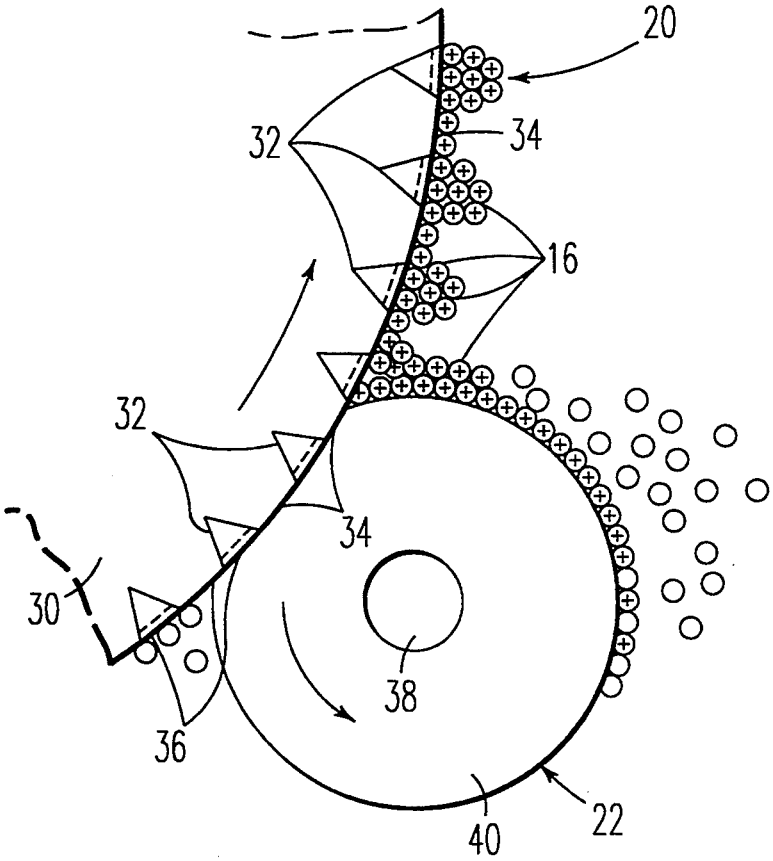
FIG. 3 is a view showing the structure of the developing roller and how a toner is deposited on the surface thereof.
Figure 4:
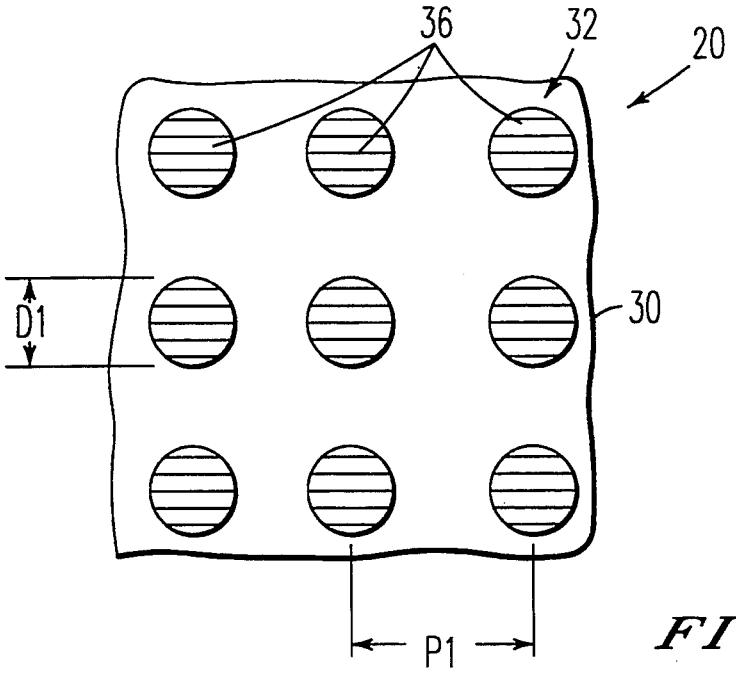
FIG. 4 is a plan view of dielectric bodies each being exposed to the outside on the surface of the developing roller.
Figure 5:
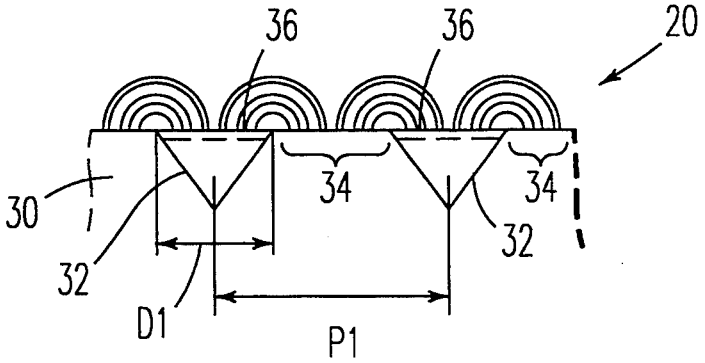
FIG. 5 is a view showing electric lines of force of microfields developed in the vicinity of the surface of the developing roller by the dielectric bodies.

As shown in FIG. 3, the developing roller 20 has a cylindrical base 30 made of aluminum, stainless steel or similar conductive material, and a great number of fine dielectric bodies 32 made of an insulating material. The dielectric bodies 32 are distributed on and affixed to the periphery of the conductive base 30. Hence, the surface of the base 30, i.e., conductive portions 34 and the surfaces 36 of the dielectric bodies 32 are exposed to the outside either regular or irregularly. The shape and size of the individual dielectric bodies 32 may be suitably selected. For example, assuming that the surfaces 36 of the dielectric bodies 32 exposed to the outside are circular, each dielectric body 32 may have a diameter D1 of 30 to 2000 μm, preferably 100 to 400 μm, and the center-to-center distance P1 between nearby dielectric bodies 32 may be 100 to 500 μm, as shown in FIGS. 4 and 5. On the other hand, assuming that the surfaces 26 of the dielectric bodies 32 are rectangular, at least one side thereof may have a length of 30 to 2000 μm. When the surfaces 36 are neither circular nor rectangular, they may be configured such that either one of the components extending in the developing direction and in the direction perpendicular thereto has a dimension of less than 2000 μm. The ratio of the area of the conductive portions 34 of the base 30 to the overall area of the developing roller 20 is selected to be 20 to 70%. When the developer carrier is implemented as a belt, a great number of such fine dielectric bodies will also be affixed to the surface of the conductive base of the belt. The dielectric bodies 32 are made of a dielectric material which will be charged by friction to the polarity opposite to that of the toner 16, i.e., to the negative polarity in the illustrative embodiment.

The toner supply roller 22 contacting the developing roller 20 is made of a material which frictionally charges the dielectric bodies 32 of the developing roller 20 in contact therewith to the polarity opposite to that of the toner 16, i.e., to the negative polarity in the illustrative embodiment. In the specific configuration shown in FIGS. 1 and 3, the toner supply roller 22 has a conductive core member 38 and a cylindrical foamed body (e.g. foamed polyurethane) 40 provided on the core member 38. The foamed body 40 is held in pressing contact with the developing roller 20 while elastically deforming itself. When the toner supply roller 22 has such a structure, the foamed body 40 may he formed of a material which negatively charges the dielectric bodies 32 by friction as mentioned above.

The developing device 10 having the above construction will be operated as follows.

The portion of the surface of the developing roller 20 moved away from the developing region 28 is caused into contact with the surface of the toner supply roller 22 as the roller 20 is rotated, as stated earlier. Then, the toner 16 remaining non-transferred on the developing roller 22 is scraped off by a scavenging force which the toner supply roller 22 exerts thereon. At the same time, the dielectric bodies 32 of the developing roller 20 are charged to the negative polarity which is opposite to the polarity of the toner 16 by the toner supply roller 22. At this instant, an electrostatic residual image ascribable to the latent image formed on the belt 12 may remain on the dielectric bodies 32 having moved away from the developing region 28. Nevertheless, since the dielectric bodies 32 are charged substantially to saturation by the friction thereof with the toner supply roller 22, such a residual image is erased to initialize the developing roller 20.

On the other hand, as shown in FIG. 3, the toner 16 contacting and driven by the toner supply roller 22 toward the developing roller 20 is charged to the positive polarity by friction thereof with the roller 22. On reaching the developing roller 20, the toner 16 is charged more intensely to the positive polarity in frictional contact with the roller 20, particularly the dielectric elements 32, and thereby caused to electrostatically deposit on the periphery of the roller 20. In this instance, the dielectric bodies 32 of the developing roller 20 have been frictionally charged to the negative polarity and are surrounded by the conductive portions 34, so that the negative charge has been selectively deposited only on the dielectric bodies 32. Hence, as shown in FIG. 5, microfields are developed between the negatively charged dielectric bodies 32 and the conductive portions 34 with the result that almost countless microfields are formed in close proximity to the surface of the developing roller 20. More specifically, assuming electric lines of force representative of a condition of an electric field, they are formed in the space adjoining the surface of the developing roller 20, as represented by arcuate lines in FIG. 5. Consequently, microfields are generated between the dielectric bodies 32 and the conductive portions 34.

Since the dielectric bodies 32 and the conductive portions 34 neighbor each other and each has an extremely small area, the microfields each is extremely intense due to the so-called edge effect or the fringing effect (peripheral field effect). The positively charged toner 16 is strongly attracted by the dielectric bodies 32 due to such microfields and, therefore, firmly retained on the developing roller 20 in a great amount. At this instance, the toner 16 has been strongly charged by the friction of the rollers 22 and 20. This, coupled with the fact that the toner 16 is retained on the roller 20 by the intense microfields, a great amount of toner 16 bearing an intense charge is carried on the roller 20. When the the toner 16 on the developing roller 20 is regulated in thickness by the doctor blade 26 which is made of urethane, for example, the sufficiently charged part of the toner 16 is firmly retained on the roller 20 by the microfields while the weakly charged part is removed by the doctor blade 26. As a result, only the intensely charged toner 16 is transported in a great amount to the developing region 28 so as to develop the latent image formed on the belt 12. This is successful in providing the resulting toner image with high density and in freeing the background of the image from contamination. The amount of charge on the toner 16 is selected to be about 5 to 20 μc/g, preferably 10 to 15 μc/g in order to enhance the sharpness of the toner image.

While the microfields are shown in FIG. 5 as being generated over the entire surface of the developing roller 20, electric fields other than the microfields may exist among the microfields. In any case, the microfields do exist and allow a great amount of toner 16 to be deposited on the developing roller 20.

Figure 6A:
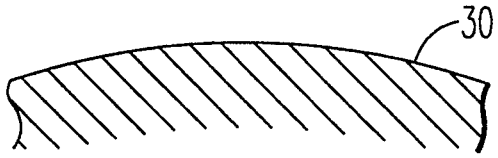
FIGS. 6A to 6D are views showing a specific procedure for fabricating the developing roller.
Figure 6B:
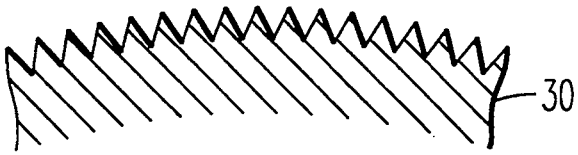
Figure 6C:
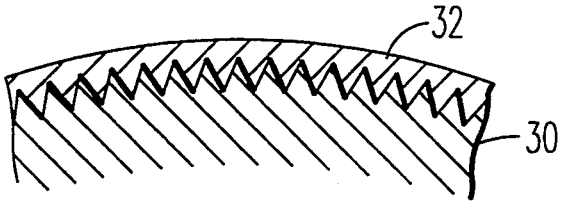
Figure 6D:
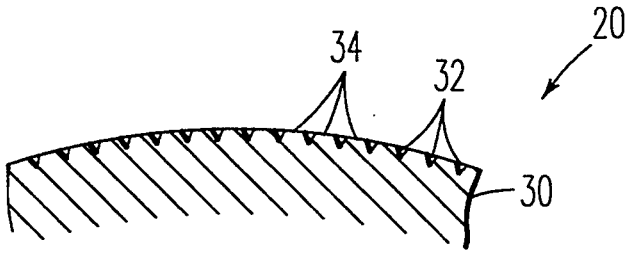

In FIGS. 1 to 5, the dielectric bodies 32 of the developing roller 20 are distributed over the entire periphery of the roller 20 and buried in generally V-shaped fine grooves formed in the surface of the conductive base 30. The developing roller 20 having such a configuration can be fabricated with ease by the following specific procedure. To begin with, as shown in FIG. 6A, the cylindrical conductive base 30 is produced by cutting or otherwise machining a member made of aluminum, copper, silver or similar metal and having a smooth surface. Then, as shown in FIG. 6B, the surface of the base 30 is roughened to about 20 to 500 μm, for example, by sand biasing, knurling or similar technology, whereby a number of V-shaped grooves are formed in the base 30. Thereafter, as shown in FIG. 6C, the toughened surface of the base 30 is coated with a dielectric material 32 such as fluoric resin. As a result, the dielectric bodies 32 are buried in the V-shaped grooves. After the dielectric material 32 has been solidified by drying, it is cut, polished or otherwise machined to expose the conductive portions 34 and dielectric bodies 32 to the outside, as shown in FIG. 6D.

Figure 7:
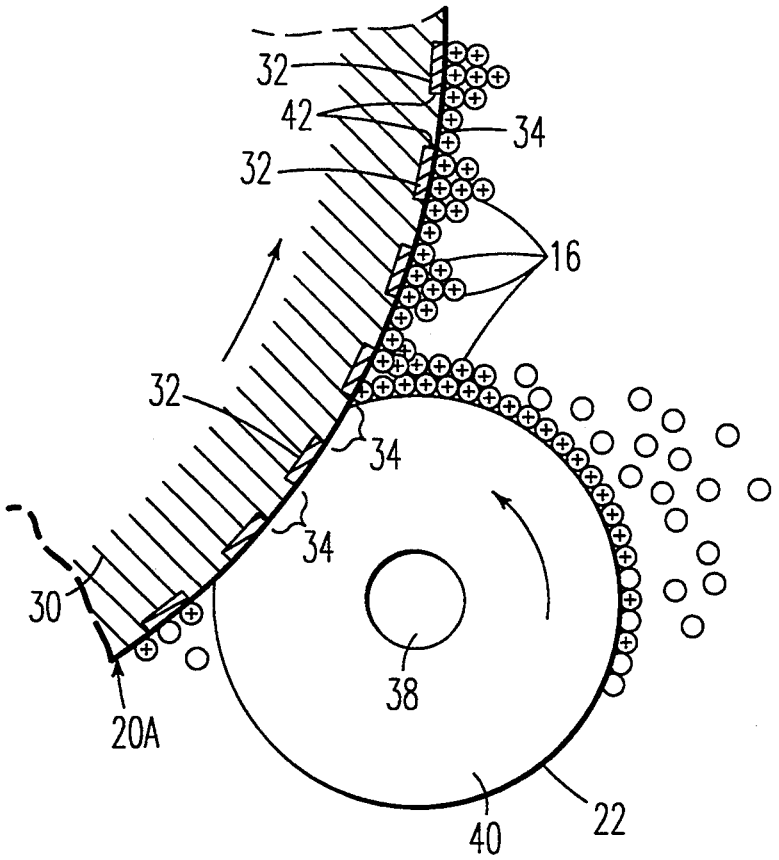
FIG. 7 is a view showing a modified form of the developing roller and a toner deposited thereon.
Figure 8:
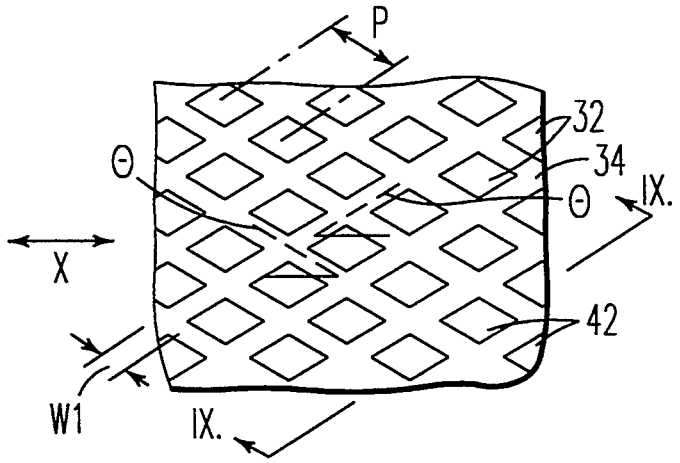
FIG. 8 is a plan view of the modified developing roller.
Figure 9:
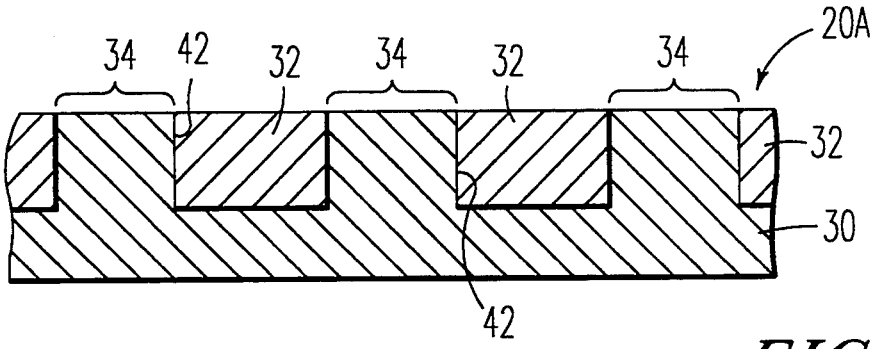
FIG. 9 is a section along line IX—IX of FIG. 8.
Figure 10:
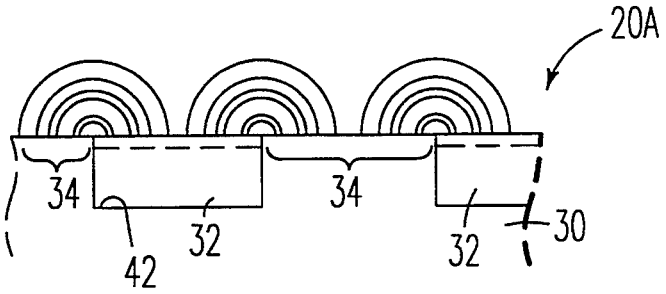
FIG. 10 is a view showing electric lines of force of microfields developed in the vicinity of the modified developing roller by the dielectric bodies.

FIGS. 7 to 9 show a developing roller 20A which is a modified form of the developing roller 20 described above with reference to FIGS. 1 to 5. As shown, the developing roller 20A has a conductive base 30 provided with a number of rectangular grooves 42 in the surface thereof, and dielectric bodies 32 buried in the grooves 42. Such dielectric bodies 32 and conductive portions 34 show themselves on the surface of the developing roller 20A in a regular or irregular arrangement, as has been the case with the developing roller 20. Hence, the dielectric bodies 32 each has a rectangular section in a plane extending along the normal of the surface of the roller 20A, i.e., a plane perpendicular to the surface of the roller 20A, as shown in FIGS. 7 and 9. As shown in FIG. 8, the rectangular grooves 42 have a width W1 ranging from about 30 to 500 μm and a pitch P ranging from about 0.06 to 1.0 mm. The ratio of the area of the grooves 42 to the overall area of the conductive portions 34 may be about 20 to 60%, preferably 20 to 40%. As shown in FIG. 10, microfields are developed between the dielectric bodies 32 and the conductive portions 34 due to a great number of electric lines of force formed in the space adjoining the developing roller 20A. In FIG. 8, the axis of the developing roller 20A is labeled X.

A specific and preferable procedure for fabricating the developing roller 20A will be described with reference to FIGS. 11A to 11D. First, as shown in FIG. 11A, a member made of aluminum, copper, iron or similar metal and having a smooth surface is cut or otherwise machined to produce the cylindrical conductive base 30. Then, as shown in FIG. 11B, the base 30 is formed with the grooves 42, FIGS. 8 and 9, by knurling or similar technology. The grooves 42 have a depth D of about 0.05 to 0.5 mm in addition to the previously mentioned width W1 and pitch P. As shown in FIG. 11C, the base 30 with the grooves 42 is coated with a dielectric material 32 such as fluoric resin and then dried. The dielectric material 32 is applied to the base 30 to such a thickness that the grooves 32 are fully buried in the material 32. The dielectric material may be implemented by Lumiflon LF200 available from Asahi Glass (japan). Such a dielectric material is coated on the surface of the base 30 and then dried at 100° for about 30 minutes. Finally, the surface of the hardened dielectric material 32 is cut or polished so that the conductive portions 34 and dielectric portions 32 show themselves on the surface of the roller 20A. As a result, the developing roller 20A having a substantially smooth surface is fabricated with the dielectric bodies 32 and conductive portions 34 each having a small area existing thereon.

The advantage attainable with the dielectric bodies 32 buried in the grooves 42 and each having a rectangular section as shown in FIGS. 7 and 9 will be described. When the cylindrical conductive base 30 is produced, it is generally not avoidable that the periphery 30′, FIG. 12A, be slightly offset relative to the axis AX of the base 30 due to production errors. For example, assuming that the diameter DM of the base 30 is 10 to 30 mm, it is not rare that the offset δ amounts to about 20 μm. Assume that the grooves 42 are formed in the surface of the base 30 having such an amount of offset, then the base 30 is coated with the dielectric material 32, and then the surface of the dielectric material 32 is cut or polished with the base 30 being rotated. Then, the amount of cutting would be non-uniform due to the offset of the surface of the base 30, i.e., the depth to which the dielectric material 32 is cut would differ from one portion to another on the base 30.

Figure 12B:
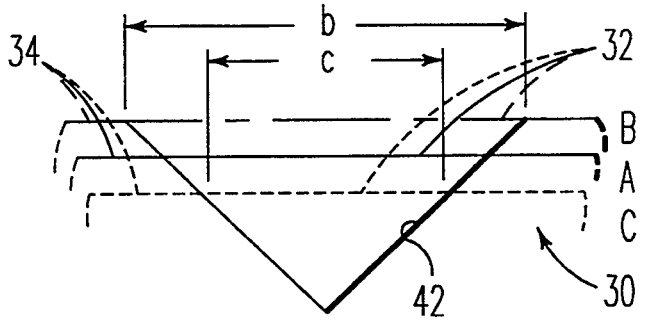
FIGS. 12B to 12D are views useful for understanding an advantage particular to rectangular grooves or U-shaped grooves formed in the surface of the developing roller and filled with the dielectric bodies.

As shown in FIG. 12B, assume that the grooves 42 of the conductive base 30 are generally V-shaped as seen in a section along the normal of the base 30, and the dielectric bodies 32 are buried in such grooves 42. Then, regarding ordinary knurling, the base 30 would be cut to a plane A in some place and to a plane B or C in another place. By comparing the portions cut to the planes B and C, it will be seen that the surface area of the dielectric body 32 exposed to the outside greatly differs, i.e., by about 250% in the worst case, as indicated by b and c in the figure. The irregularity in the area of the dielectric bodies 32 directly translates into the irregularity in the intensity of the microfields which will be generated in the vicinity of the developing roller 20A, as stated earlier. As a result, the amount of toner 16 deposited on the developing roller 20A and, therefore, on the latent image on the belt 12 would become irregular to effect the density distribution of the resulting toner image.

Figure 12C:
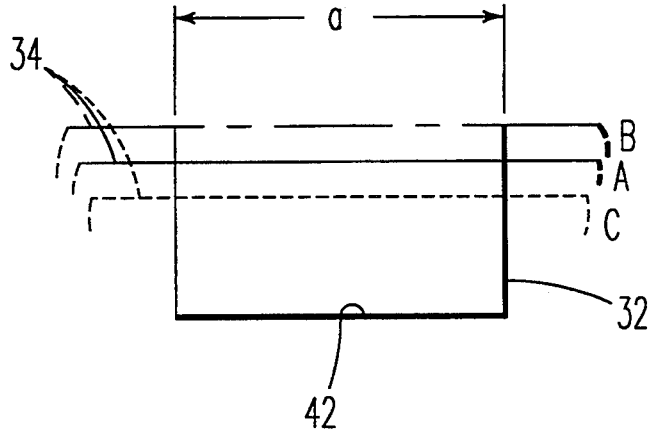

By contrast, assume the dielectric bodies 32 each having a rectangular section, as shown in FIGS. 7, 9 and 12C. Then, each dielectric body 32, whether it be cut to the plane A, B or C, has substantially the same width a. Hence, despite the offset of the base 30, the ratio in area of the dielectric bodies 32 to the conductive portions 34 is maintained substantially constant over the entire surface of the developing roller 20A. It follows that a uniform microfield intensity distribution is set up over the entire developing roller 20A to allow the roller 20A to carry the toner 16 evenly thereon, whereby a high quality toner image free from an irregular density distribution is achievable.

Figure 12D:
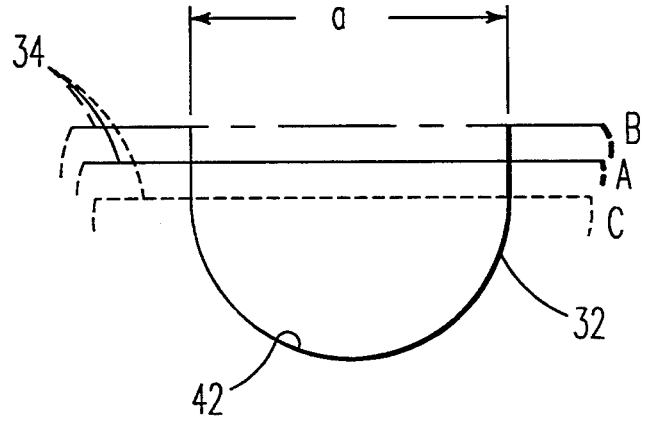

If desired, the dielectric bodies 32 may each be provided with a generally U-shaped section in place of the rectangular section, as shown in FIG. 12D. The section in the form of a letter U is also successful in achieving the above advantage.

Figure 13:
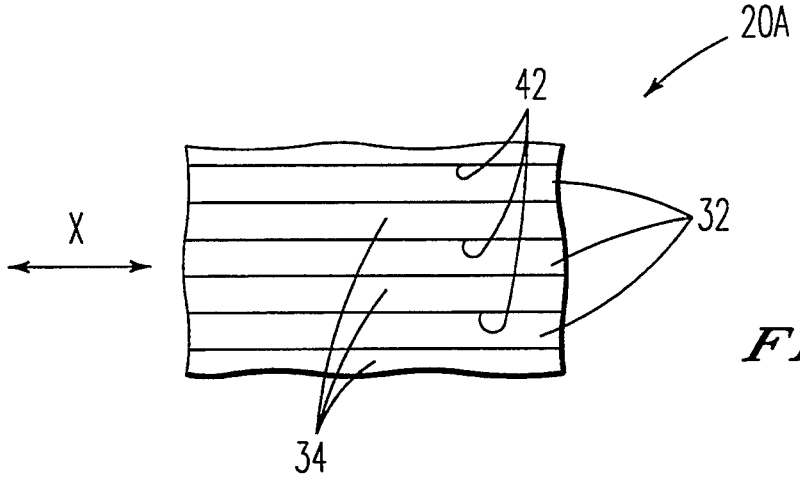
FIGS. 13 to 17 are views each showing an alternative configuration of the dielectric bodies exposed to the outside on the surface of the developing roller.
Figure 14:
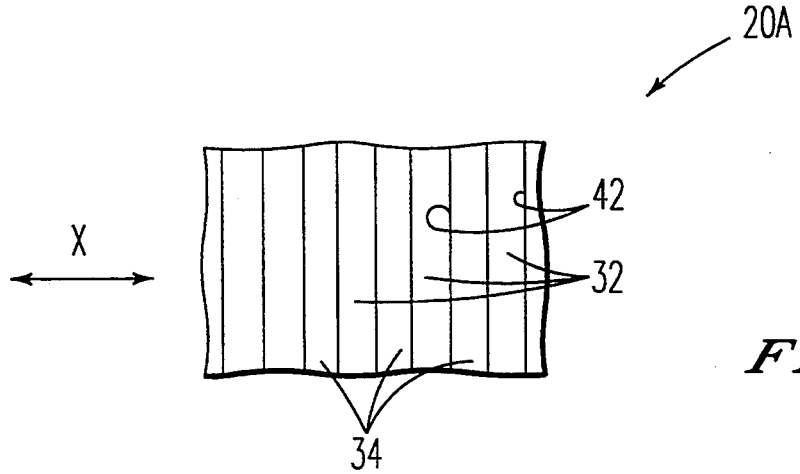
Figure 15:
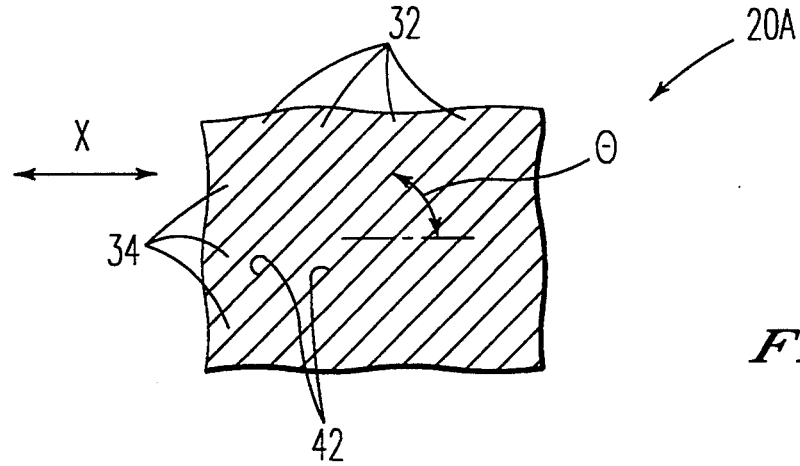

As shown in FIG. 13, the dielectric bodies 32 appearing on the surface of the developing roller 20A may extend in parallel with the axis X of the roller 20A. Alternatively, as shown in FIG. 14, they extend perpendicularly to the axis X of the roller 20A, i.e., along the circumference of the roller 20A. However, when the roller 20A with the dielectric bodies 32 shown in FIG. 13 or 14 is used to develop a latent image, it is likely that the resulting toner image suffers from irregularities corresponding to the dielectric bodies 32 since a greater amount of toner is deposited on the dielectric bodies 32 on the roller 20A than the others. FIGS. 8 and 15 show the conductive bodies 34 which extend on the developing roller 20A in a lattice or helical configuration with an angle of $\theta$ to the axis X of the roller 20A. Such a lattice or helical configuration allows the toner 16 deposited in a great amount on the surface of the roller 20A, especially on the dielectric bodies 32, to be leveled in the developing region 28, thereby freeing the toner image from irregularities. Experiments showed that this kind of irregularities of a toner image is effectively suppressed when the angle $\theta$ of the dielectric bodies 34 to the axis X of the roller 20A ranges from about 30 to 60 degrees.

Figure 16:
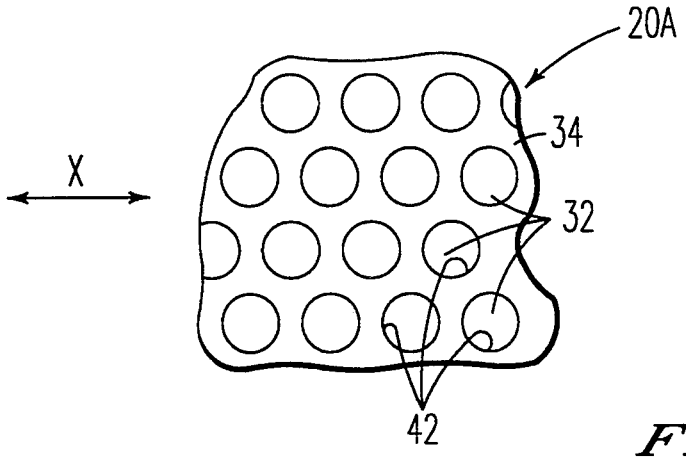
Figure 17:
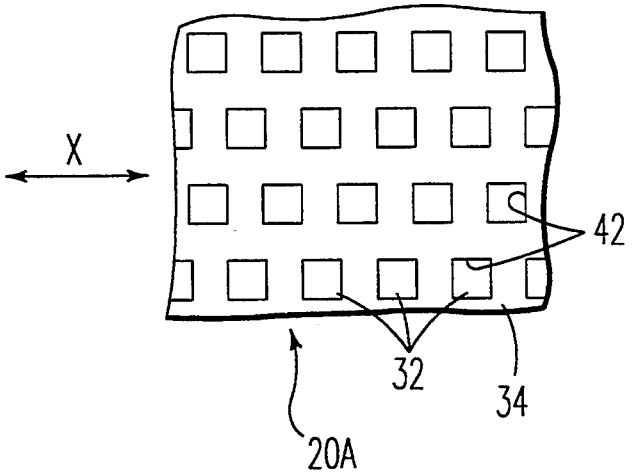

The shape of the dielectric bodies 32 as seen on the surface of the developing roller 20A may be circular or rectangular, as shown in FIG. 16 or 17. Then, it is preferable that the dielectric bodies 32 be arranged in a staggered or random configuration and not aligned along the axis X or the circumference of the roller 20A. The dielectric bodies 32 having a circular or rectangular surface may have a diameter or a side ranging from about 30 to 500 $\mu$m each and a pitch of about 60 to 1000 $\mu$m.

When a developer carrier in the form of a belt is used, the cylindrical conductive base 30 will be replaced with a sheet-like conductive base having the dielectric bodies 32 buried in the rectangular or U-shaped recesses 42 thereof. This kind of conductive base may be fabricated by substantially the same procedure as shown in FIGS. 11A to 11D.

Figure 18:
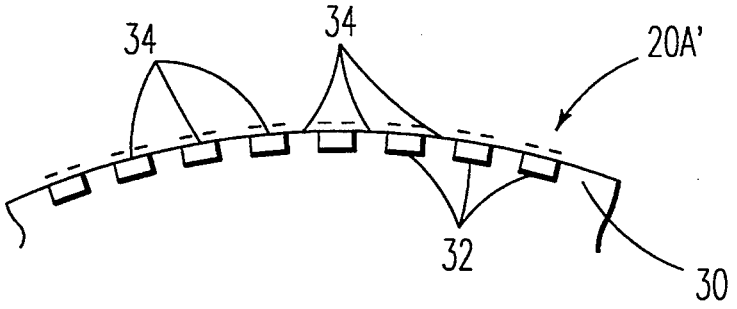
FIGS. 18 to 20 are views showing another modified developing roller and the results of experiments conducted to prove the advantage thereof over a conventional developing roller.
Figure 19:
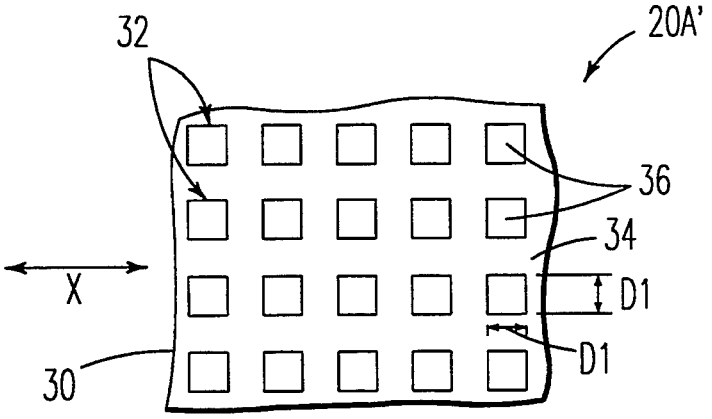
Figure 20:
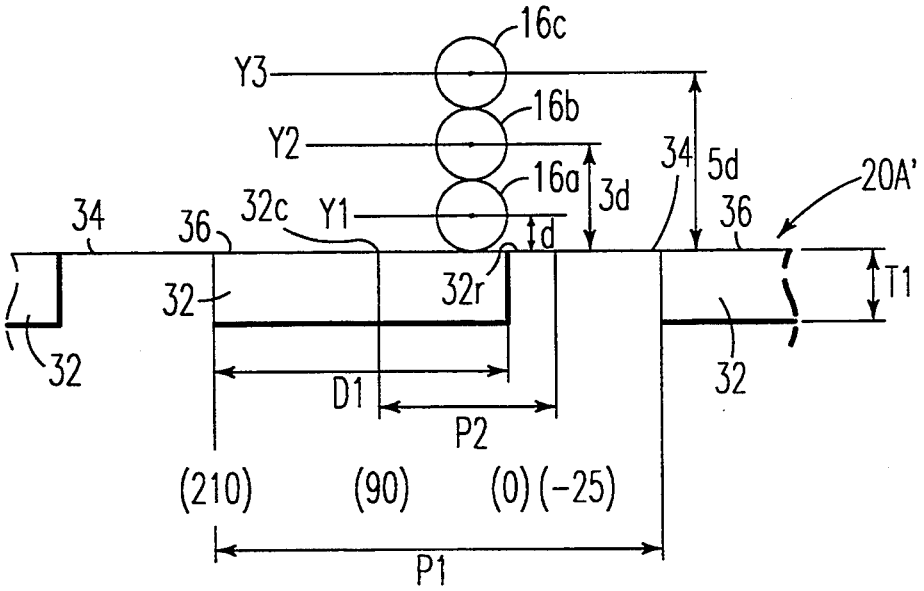

FIGS. 18 to 20 show a modification of the developing roller described above with reference to FIGS. 7 to 9. As shown, the developing roller 20A' has the dielectric bodies 32 each extending at an angle of $\theta$ which is 90 degrees to the axis of the roller 20A'. The advantage attainable with the developing roller 20A' will be described by comparing it with a conventional developing roller on the basis of the results of experiments.

First, the developing roller 20A' was produced by arranging a great number of rectangular parallelepiped dielectric bodies 32 (e.g. Lumiflon LF 200, specific inductivity $\epsilon=2.7$) each having a side D1 of 210 $\mu$m and a depth T1 of 100 $\mu$m on the surface of the cylindrical conductive base 30 made of aluminum at a pitch of 300 $\mu$m, as shown in FIGS. 18 to 20. At the same time, a conventional developing roller **20*a* was prepared which was constituted by a conductive base 30*a* made of aluminum and a uniform layer of dielectric material 32*a* deposited on the entire surface of the base 30*a* to a depth T2 of 100 $\mu$m. The dielectric material 32*a* had a specific inductivity $\epsilon$ of 10. The dielectric bodies 32 and the dielectric layer 32*a* were charged by friction to $-200$ V in terms of surface potential, and in this condition the electric fields in the vicinity of the surfaces of the developing rollers 20A' and 20*a*** were measured. Generally, the force F attracting a toner to the surface of a developing roller is determined by the intensity E of the electric field as measured on or in the vicinity of the roller surface and the amount of charge q deposited on the toner particles, i.e. $F=qE$. Hence, assuming that the amount of charge on the toner particles is constant, then the force attracting the toner to the developing roller and, therefore, the amount of toner deposition on the roller increases with the increase in the intensity of the field.

Figure 22:
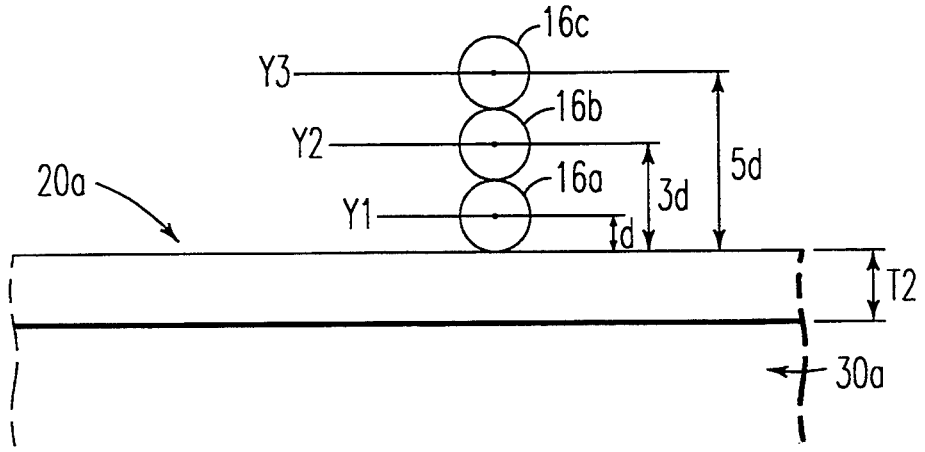
FIG. 22 PRIOR ART

As shown in FIGS. 20 and 22, toner particles **16*a*, 16*b* and 16*c* were assumed to have a radius d of 5.0 $\mu$m. The electric field was determined at a first position Y1 spaced apart by a distance d of 5.0 $\mu$m between the surface of each roller 20A' or 20*a* and the center of the toner particle 16*a* lying in the first layer, a second position Y2 spaced part by a distance 3*d* of 15 $\mu$m between the roller surface and the toner particle 16*b* lying in the second layer, and a third position Y3 spaced apart by a distance 5*d* between the roller surface and the toner particle 16*c* lying in the third layer. Regarding the direction of electric field, the outward direction along the normal of the roller was assumed to be positive. Hence, a negative electric field means that it attracts the toner 16** to the surface of the roller.

Figure 21:
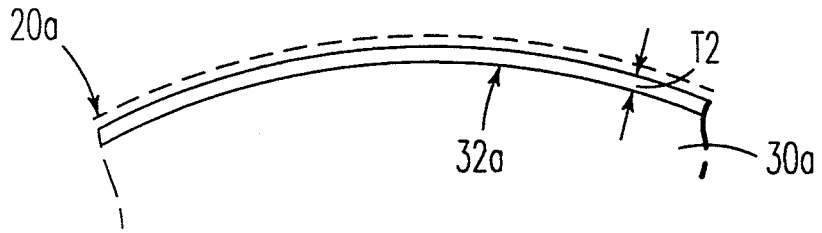
FIG. 21 PRIOR ART
FIGS. 21 and 22 are views showing the conventional developing roller.
Figure 23A:
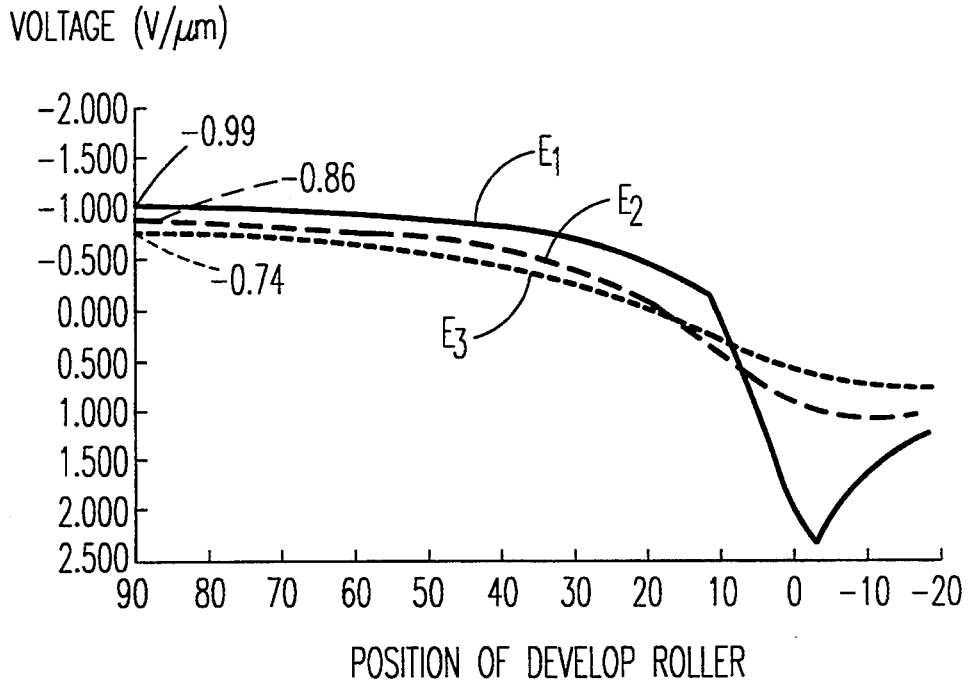
FIGS. 23A and 23B indicate electric fields developed in the vicinity of the surface of the developing roller shown in FIGS. 18 to 20.
Figure 23B:
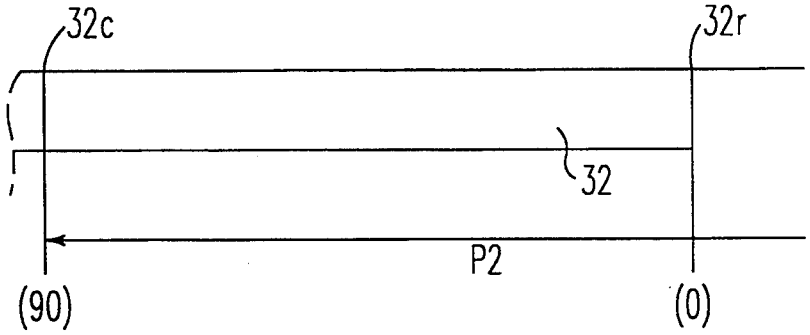
Figure 24:
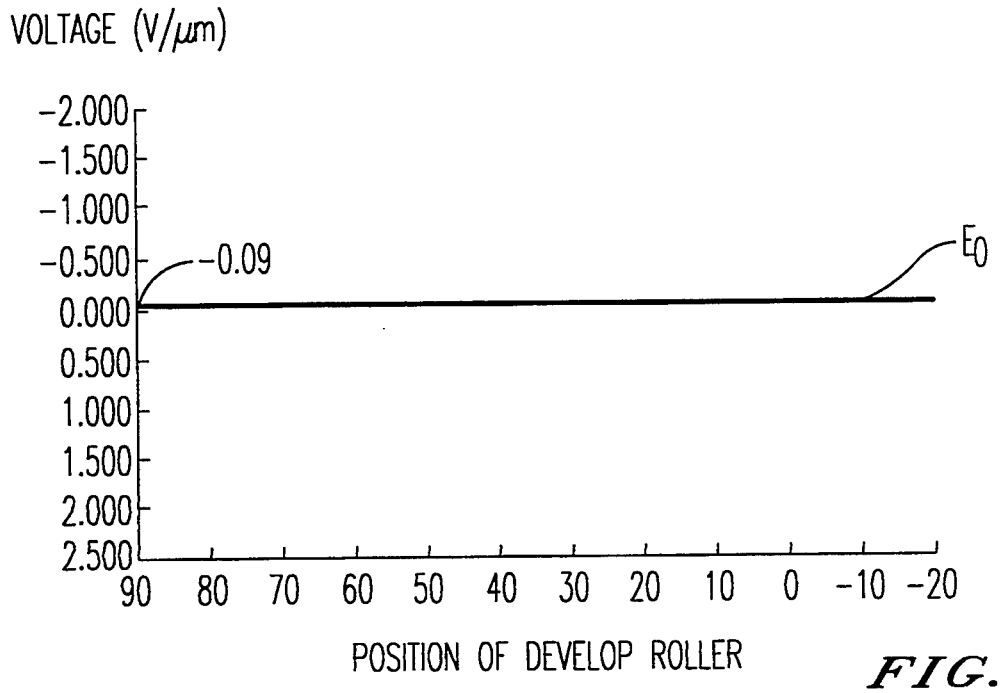
FIG. 24 PRIOR ART
FIG. 24 indicates electric fields generated in the vicinity of the surface of the conventional developing roller shown in FIGS. 21 and 22.

FIG. 23A indicates the electric fields particular to the developing roller 20A' shown in FIGS. 18 to 20, while FIG. 24 indicates the electric fields particular to the conventional developing roller **20*a* shown in FIGS. 21 and 22. In these figures, the ordinate and the abscissa indicate respectively the intensity of electric field (V/$\mu$m) and the position in the circumferential direction of the rollers 20A' and 20A. Specifically, FIG. 23A is representative of the intensities of electric fields developed over at particular length P2 as measured in the circumferential direction of the roller 20A' and containing a single dielectric body 32 (see FIG. 20 also), as will be seen by comparing it with FIG. 23B. In FIG. 23A, "0" on the abscissa corresponds to the right edge 32*r* of the single dielectric body 22 as viewed in FIGS. 20 and 23B, while "90" corresponds to substantially the center 32*c* of the dielectric body 22** in the circumferential direction.

In FIG. 24, the line $E_o$ indicates the intensity of electric field measured at the first, second and third positions Y1, Y2, and Y3, FIG. 20, adjacent to the surface of the developing roller **20*a*. As shown, the intensity was measured to be $-0.09$ V/$\mu$m at all of the three positions Y1, Y2, and Y3. In FIG. 23A, the lines $E_1$, $E_2$ and $E_3$ indicate respectively the intensities of electric fields measured at the positions Y1, Y2 and Y3. As shown, the maximum field intensities at the positions Y1, Y2 and Y3 are respectively $-0.99$ V/$\mu$m, $-0.86$ V/$\mu$m, and $-0.74$/$\mu$m which are substantially seven to ten times greater than $-0.09$ V/$\mu$m attainable with the conventional roller 20*a*. In this manner, the developing 20A' shown in FIGS. 18 to 20 achieves far more intense electric fields than the conventional developing roller 20*a* shown in FIGS. 21 and 22 and thereby allows a great amount of charged toner to deposit thereon. As shown in FIGS. 23A and 23B, the field intensity is greatest substantially at the center of the dielectric body 32. Presumably, this is because when one side of the dielectric body 32 is dimensioned about 200 $\mu$m, the fringing effect is exhibited over the entire dielectric body to intensify the field intensity at the center 32c than at the right edge 32*r***.

With the conventional developing roller **20*a*, the amount of toner 16 which can be transported to the developing region 28 as stated earlier is short. It has been customary, therefore, to rotate the developing roller 20*a* at a three to four times higher speed than the photoconductive element 12 so as to transport a greater amount of toner 16 to the developing region 28 and thereby to prevent the density of the toner image from being lowered. This, however, brings about a drawback that a solid image formed on the belt 12 has unusually high density at a trailing edge portion thereof with respect to the moving direction of the belt 12, compared to the other portion, resulting in poor image quality. Another drawback with the higher rotation speed of the developing roller 20a is that the rotation tends to become irregular and thereby causes irregularlity to occur in the image density. By contrast, the developing roller 20A' of the present invention transports a great amount of toner to the developing region 23 and, therefore, does not have to be rotated at a higher speed. More specifically, the roller 20A' can be moved at the same or substantially the same speed as the belt 12, insuring a toner image free from an irregular density distribution. Further, when the rotation speed of the developing roller 20A'** is reduced as stated above, a miniature and inexpensive motor suffices. In addition, the load acting on the toner is reduced to lengthen the service life of the toner.

Referring again to FIG. 1, while the conductive base 30 of the developing roller 30 may be simply connected to ground, it is preferable that a bias voltage be applied from a power source 44a to the base 30 to prevent the background of a toner image formed on the belt 12 from being contaminated. If desired, a bias voltage may be applied to the base 30 and the toner supply roller 22 from a power source 44b independent of the power source 44a to maintain the base 30 and roller 22 at the same potential or to cause the toner 16 to be attracted toward the roller 20 away from the roller 22. This will further increase the amount of toner deposition on the developing roller 20. Such a bias voltage may be implemented with DC, AC, DC superposed on AC, or pulse voltage. It is also possible for the doctor blade 26 to further increase and stabilize the amount of charge of the toner 16 deposited on the developing roller 20.

Figure 25:
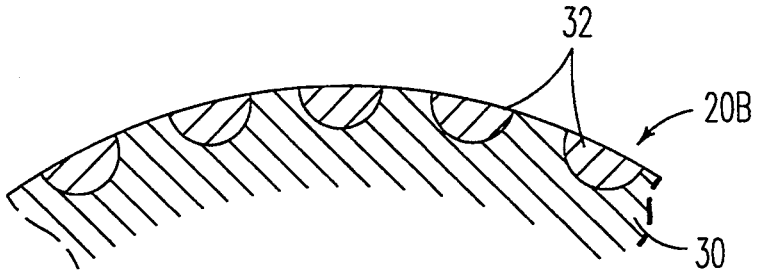
FIGS. 25 and 26 are sections each showing another modified developing roller.
Figure 26:
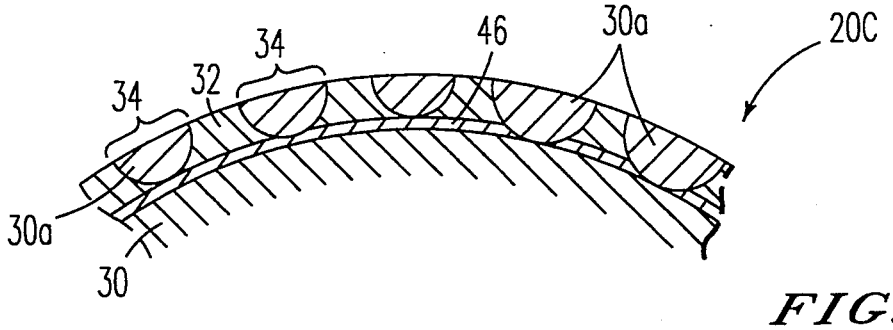

The developing rollers 20, 20A and 20A' shown in FIGS. 3 to 20 each has the dielectric bodies 32 buried in the fine V-shaped or rectangular grooves formed in the surface of the conductive base 30. Besides, other various kinds of developing rollers may be fabricated by particular methods. For example, FIG. 25 shows a developing roller 20B having a great number of fine particles of dielectric material 32 buried in the conductive base 30 thereof. FIG. 26 shows a developing roller 20C having the conductive base 30, a layer of dielectric material 32 formed on the base 30, and a great number of fine conductive bodies 30a buried in the dielectric layer 32. In the configuration shown in FIG. 26, the conductive body 30a are electrically coupled to the conductive base 30 and, therefore, form a part of the base 30. The conductive bodies 30a, i.e., conductive portions 34 and the dielectric material 32 of the developing roller 20C are exposed to the outside either regularly or irregularly. The conductive portions 34 appearing on the surface of the developing roller 20C are dimensioned 5 to 300 μm each, for example, and occupy about 20 to 50% of the overall peripheral area of the roller 20C. A specific procedure for fabricating the developing roller 20C is as follows. The procedure begins with a step of producing the conductive base 30 having a smooth surface and made of aluminum, copper, iron or similar metal. As shown in FIG. 26, the base 30 is coated with a conductive adhesive 46. A great number of fine particles of conductive material 30a such as aluminum, copper or iron and each having a diameter of 5 to 300 μm are affixed to the adhesive 46, and the adhesive is dried. By the steps described so far, the conductive bodies 30a are electrically coupled to the conductive base 30 while forming a part of the latter. Subsequently, the dielectric material 32 which may be resin is applied in such a manner as to bury the dielectric particles 30a, then dried, and then polished to cause the conductive portions 34 and dielectric body 32 to appear on the surface of the roller 20C, as shown in FIG. 26.

The developing rollers 20, 20A, 20A' and 20B shown in FIGS. 3 to 20 and 25 each has the spaced dielectric bodies 32 appearing on the surface of the roller, while the developing roller 20C shown in FIG. 26 has the spaced conductive portions 34 appearing on the surface thereof. In any case, the dielectric bodies 32 and conductive portions 34 are distributed on the roller surface either randomly or regularly and, therefore, effectively form the previously stated microfields, allowing the roller to carry a great amount of toner thereon.

A developing device in accordance with the present invention and a copier incorporating it were constructed and tested under the following conditions.

(1) linear velocity of photoconductive element: 120 mm/sec
(2) linear velocity of developing roller: 132–144 mm/sec
(3) diameter of developing roller: 25.4 mm
V-shaped groove: pitch of 0.35 mm, depth of 0.1 mm, width of 0.15 mm, and knurling angle of 45°
(4) A dielectric element implemented with fluoric resin (Lumiflon LF200) is applied to a conductive base having a knurled surface, dried at 100° for about 30 minutes, and then cut to cause conductive portions to appear. The conductive portions and the dielectric bodies occupy respectively 39% and 61% of the overall area.
(5) linear velocity of toner supply roller: 0.5–0.6 times higher than linear velocity of developing roller in opposite direction
(6) material of toner supply roller: sponge roller treated with foaming polyurethane carbon, diameter of 14 mm
(7) bite of toner supply roller into developing roller: 1 mm
(8) resistance of toner supply roller: $10^7$ Ω·cm on surface
(9) doctor blade: resilient member (phosphor bronze with t=0.1) to which fluoric resin PTFE sheet (PTFE resin tape 200μ available from Nichias (Japan)) is adhered
(10) bias voltage for developing roller: pulse voltage of 500 V (P-P), 250 Hz, DC-250 V superposed application duty ratio (high potential portion time/cycle time)=0.7
(11) photoconductive element: OPC
(12) toner: positively charged toner
(13) auxiliary agent for toner: 0.5 Wt % of $SiO_2$ fine powder The developing device operated under the above conditions caused the toner to deposit on the developing roller passed the doctor blade by an amount of 0.5 to 1.0 mg/cm$^2$ and charged the toner by 5. to 15 μc/g, whereby a stable toner layer was achieved.

In the developing device 10 shown in FIG. 1, the development is effected by the contact of the belt 12 and the developing roller 20 with the intermediary of the toner. Non-contact type development as distinguished from such contact type development will also achieve the above advantages if a gap of 0.05 to 0.3 mm is formed between the belt 12 and the roller 20, the belt 12 and roller 20 are moved substantially the same linear velocity, and the bias voltage is changed.

Second Embodiment

In the developing device 10 shown in FIG. 1, the charging means for charging the dielectric bodies 32 to the polarity opposite to the polarity of the toner 16 by friction is constituted by the toner supply roller 22 which is held in contact with the developing roller 20. The toner supply roller 22 is used to supply the toner 16 to the developing roller 20 and to charge the dielectric bodies 32. Such a construction eliminates the need for extra charging means other than the toner supply roller 22 and thereby cuts down the cost. However, since the dielectric bodies 32 have to be charged with some toner 16 existing between the rollers 20 and 22, the charging efficiency is somewhat lowered and, therefore, the amount of toner deposition on the roller 20 may be reduced. A second embodiment of the present invention which will be described with reference to FIGS. 27 and 28 are free from such an occurrence.

Figure 27:
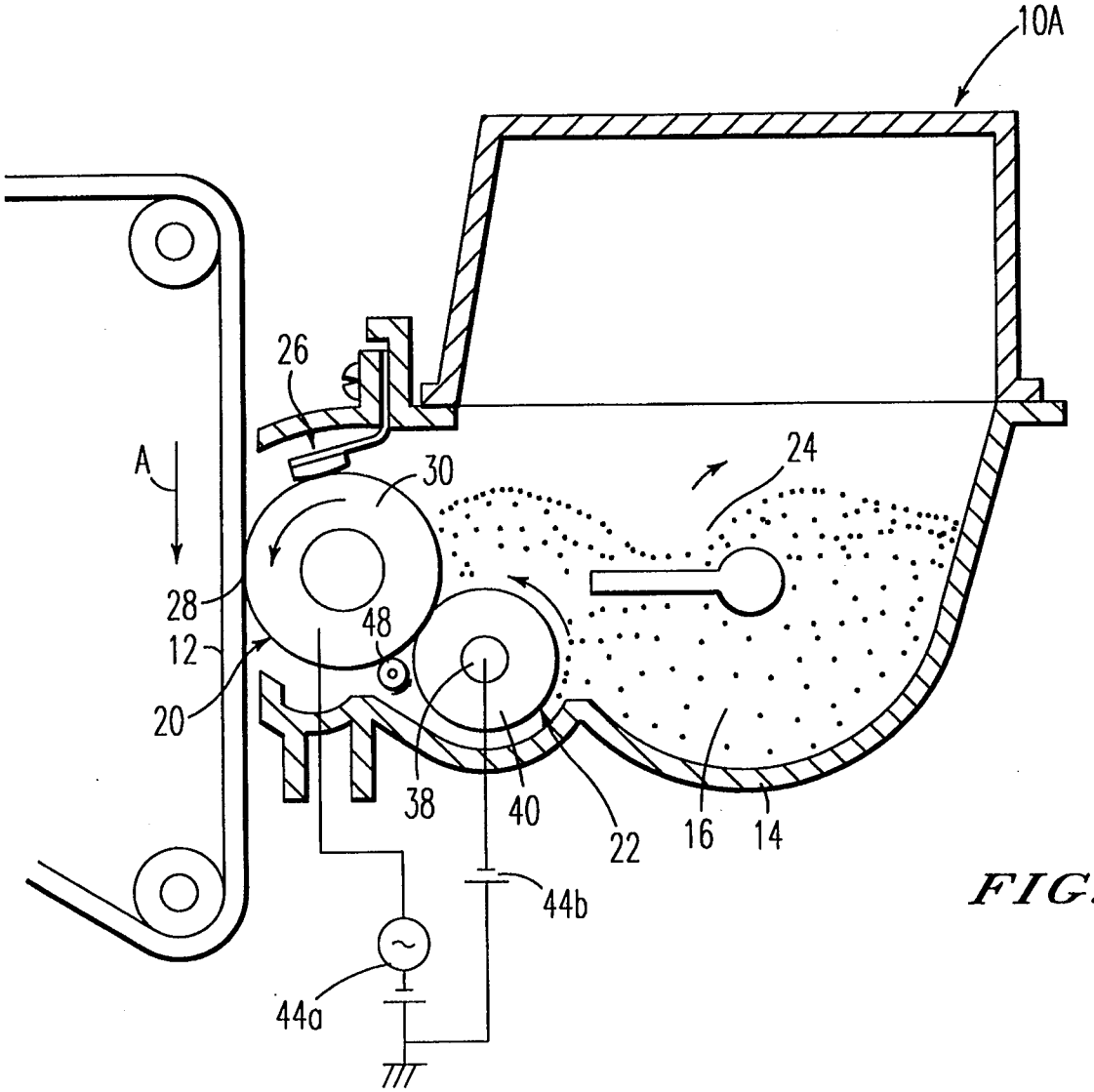
FIGS. 27 an 28 are sections showing a second embodiment of the present invention.
Figure 28:
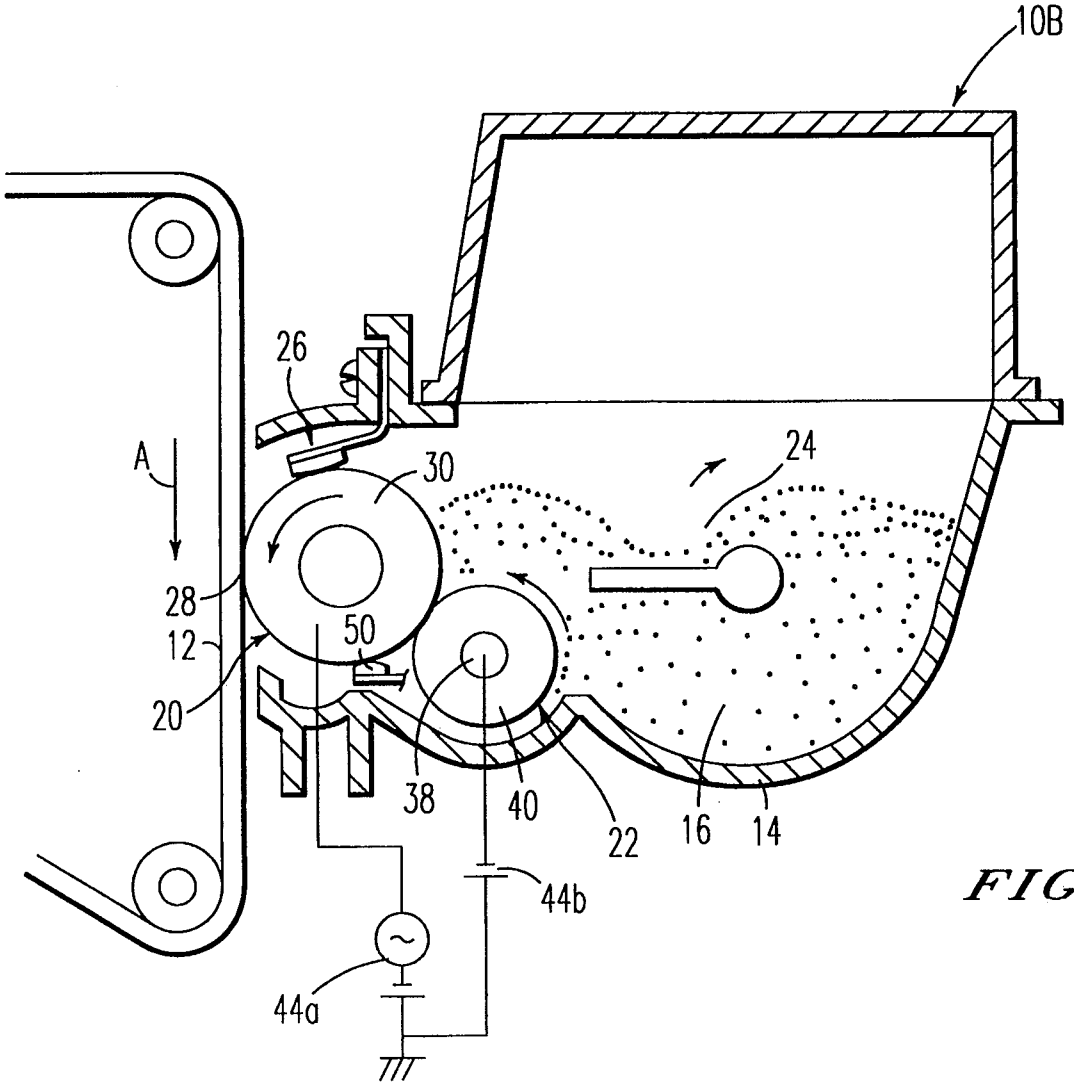

Specifically, developing devices 10A and 10B shown in FIGS. 27 and 28, respectively, each has a frictional charging member 48 or 50 in addition to the toner supply roller 22 for the purpose of frictionally charging the dielectric bodies 32 of the developing roller 20 to the polarity opposite to the polarity of the toner. The charging members 48 and 50 each is held in contact with a part of the periphery of the developing roller 20 which is positioned downstream of the developing region 28 and upstream of the toner supply roller 22 with respect to the rotating direction of the roller 20, i.e., the toner transporting direction.

The charging member 48 shown in FIG. 27 is implemented as a roller which comprises, for example, a core and a layer of foaming material (sponge) provided on the core. Regarding the foaming material, use may be made of silicon-urethane-based material when the toner 16 should be positively charged or fluoric resin-coated urethane-based material when the toner 16 should be negatively charged. On the other hand, the charging member 50 shown in FIG. 28 is implemented as a blade. The blade 50 may be formed of silicon- or urethane-based rubber when the expected charge of the toner 16 is positive or fluoric resin-coated urethane rubber when it is negative.

Figure 29:
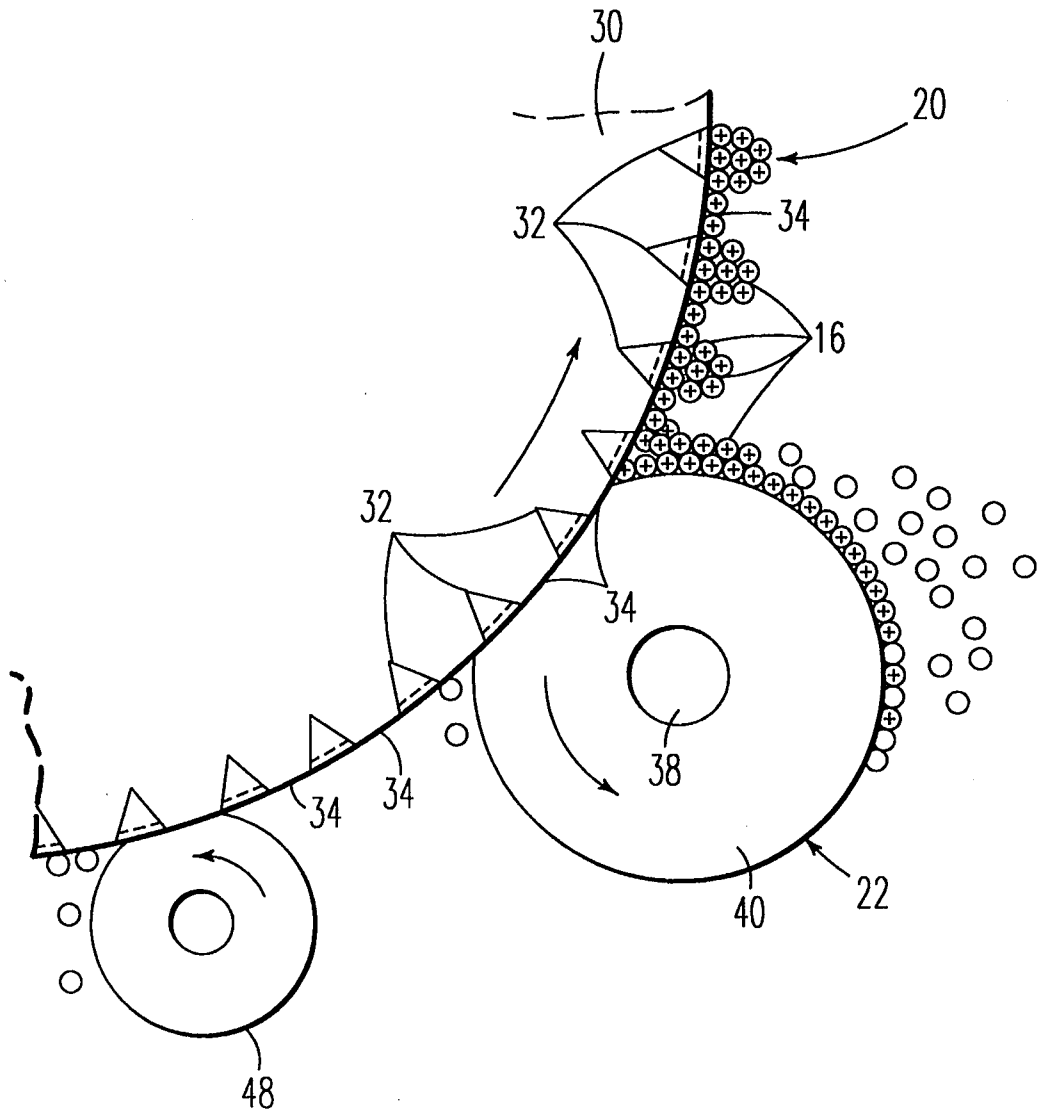
FIGS. 29 and 30 are views showing respectively the operations of charging device included in the developing devices of FIGS. 27 and 28.
Figure 30:
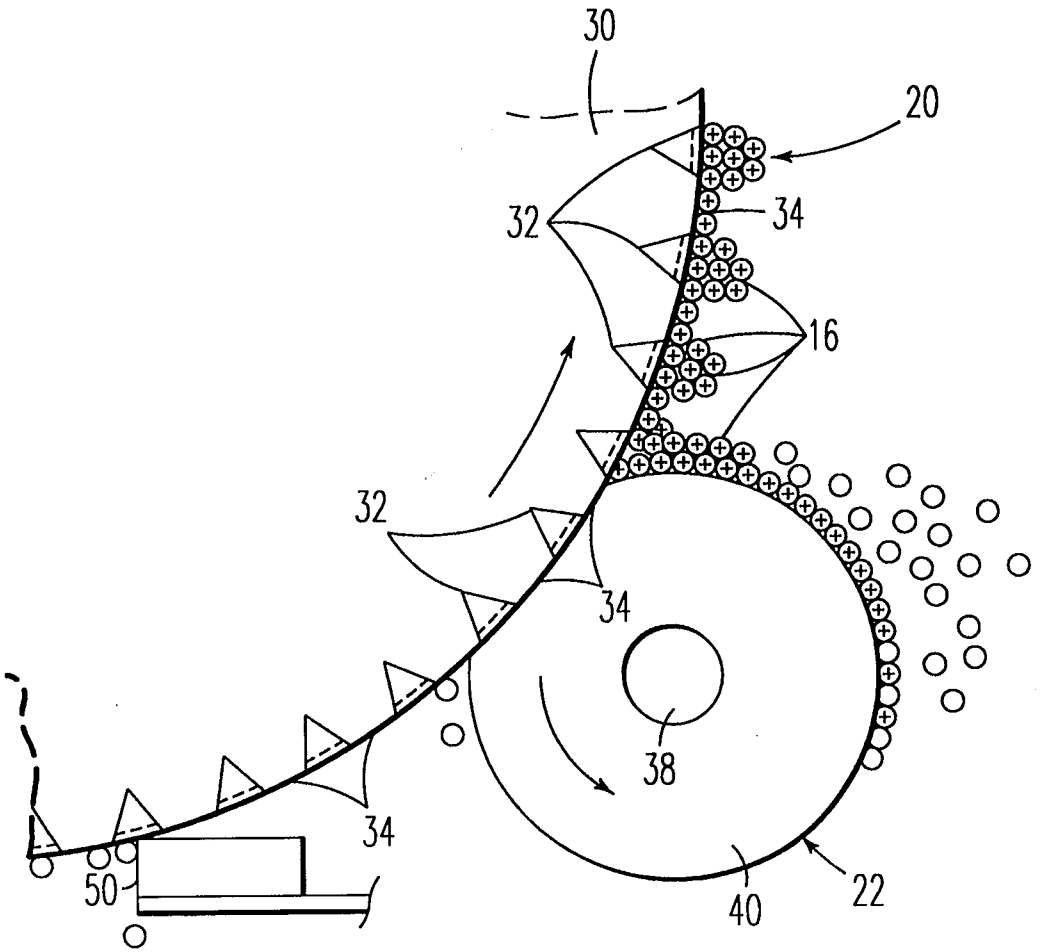

As shown in FIGS. 29 and 30, the charging members 48 and 50 each removes the toner 16 remaining on the developing roller 20 which has moved away from the developing region 28, while frictionally charging the dielectric bodies 32 of the roller 20 to the opposite polarity to the toner 16, as in FIG. 3. However, it is noteworthy that the charging members 48 and 50 do not supply any toner to the developing roller 20 and, hence, effectively charge the dielectric bodies 32 to the predetermined polarity by friction.

Regarding the material of the toner supply roller 22, it may be selected such that the roller 22 intensifies or does not intensity the charge deposited on the electric bodies 32 by the charging member 48 or 50. Of course, the toner supply member may be constituted by an elastic roller or a fur brush roller, for example in place of the roller with a foaming material (sponge). While friction type charging means in the form of the toner supply member 22 and charging member 48 and 50 has been used to charge the dielectric bodies 32, a corona discharger, charge injecting member pressed against the developing roller 20 or similar charging means may be substituted therefor. Further, an exclusive member for removing the remaining toner may be used in addition to the frictional charging members 48 and 50.

Third Embodiment

Figure 31:
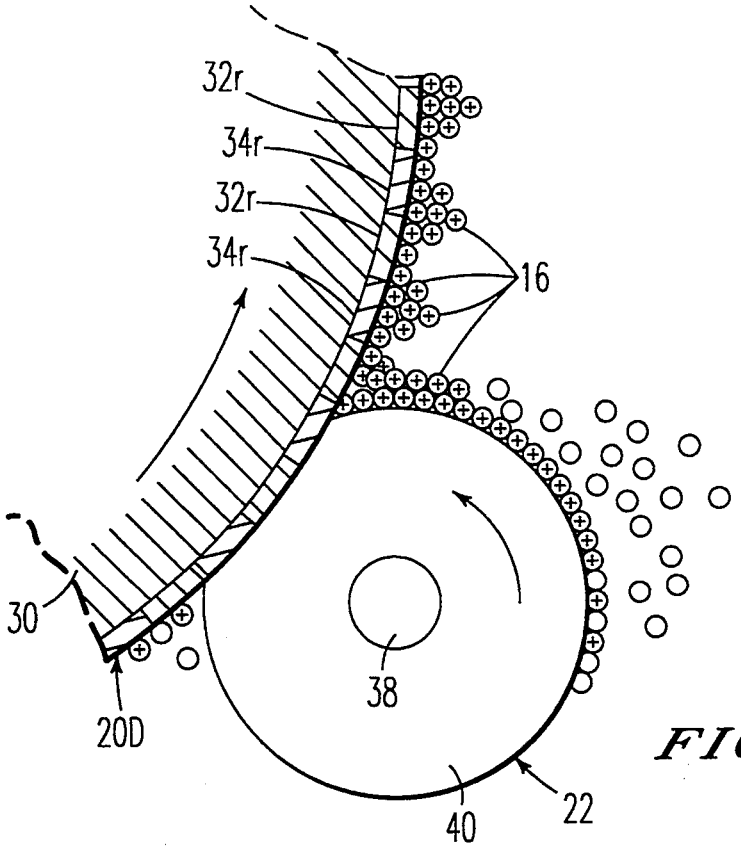
FIG. 31 is a view showing a third embodiment of the present invention and toner deposition particular thereto.
Figure 32:
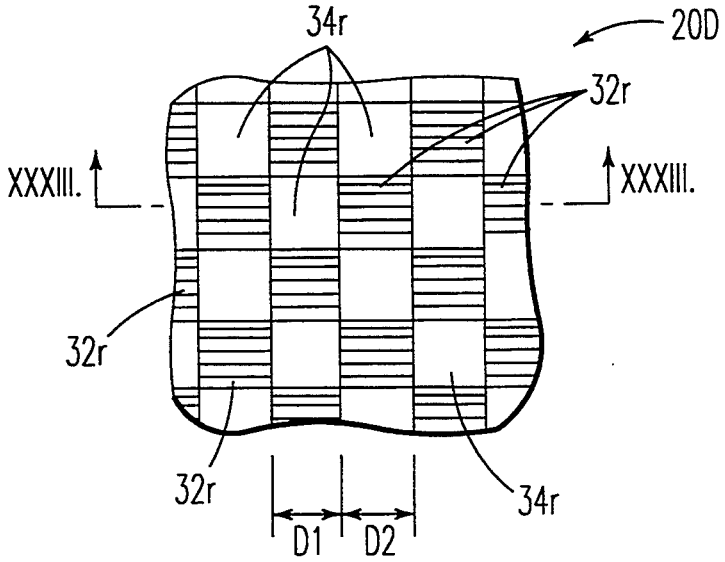
FIG. 32 is a view showing the arrangement of high resistance bodies and medium resistance bodies on the surface of a developing roller shown in FIG. 31.
Figure 33:
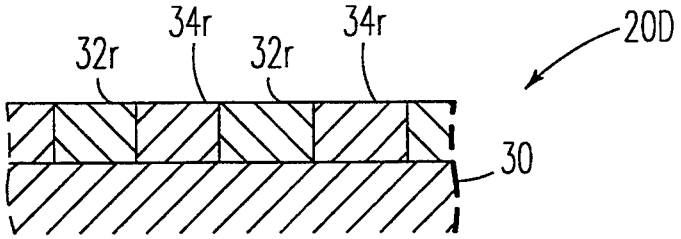
FIG. 33 is a section along line IIIXIII—IIIXIII of FIG. 32.

A reference will be made to FIGS. 31 to 33 for describing a third embodiment of the present invention which is directed toward enhancing the reproduction of tones of an image. As shown, the developing roller, generally 20D, has the conductive base 30 made of aluminum, iron, copper or similar metal, and medium resistance bodies 34*r* and high resistance bodies 32*r* affixed to the periphery of the base 30. The medium resistance bodies 34*r* have a resistivity which is higher than that of the surface of the base 30 and selected to be about $10^3$ to $10^8$ Ω·cm, for example. The high resistance bodies 32*r* have a resistivity which is higher than that of the medium resistance bodies 34*r* and selected to be $10^9$ to $10^{15}$ Ω·cm, for example. In FIG. 32, the high resistance bodies 32*r* are distinguished from the medium resistance bodies 34r by horizontal lines for illustration. As FIGS. 31 to 33 indicate, the high and medium resistance bodies 32*r* and 34*r* are arranged either in a regular pattern or in an irregular pattern and exposed on the surface of a developing roller 20D.

The medium and high resistance bodies 34*r* and 32*r* may each have any suitable configuration. When the resistance bodies 32*r* and 34*r* each is provided with a rectangular surface as shown in FIG. 32 by way of example, one side of the rectangle D1 or D2 may be dimensioned 30 to 500 μm, for example. The gist is that the dimensions and resistivity of the resistance bodies 32*r* and 34*r* be adequately selected to intensify microfields and thereby to deposit an optimum amount of toner 16 on the developing roller 20D. In the illustrative embodiment, the resistance bodies 32*r* and 34*r* are made of a substance which will be charged to the opposite polarity to the toner 16, i.e., to the negative polarity. In the case that the developer carrier is implemented as a belt, such high and medium resistance bodies will be arranged on and affixed to the surface of the conductive base of the belt.

In operation, the part of the surface of the developing roller 20 moved away from the developing region 28 is brought into contact with the toner supply roller 22. Then, the roller 22 scrapes off the toner 16 mechanically and electrically from the developing roller 20D. At the same time, the high and medium resistance bodies 32*r* and 34*r* contact the toner supply roller 22 and are thereby frictionally charged to the negative polarity opposite to the polarity of the toner 16. Although an electrostatic residual image ascribable to the latent image on the belt 12 may remain on the resistance bodies 32 and 34 having moved away from the developing region 28, it is erased since the resistance bodies 22*r* and 34*r* are charged substantially to saturation due to friction thereof with the toner supply roller 22. As a result, the developing roller 20D is successfully initialized in spite of such a residual image.

Figure 34:
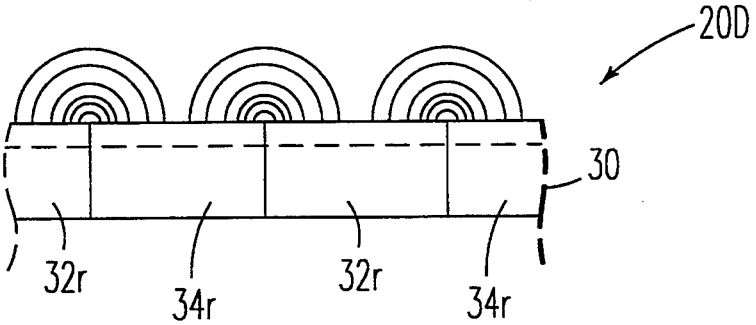
FIG. 34 is a view showing electric lines of force of microfields developed in the vicinity of the developing roller shown in FIG. 31.

On the other hand, the toner 16 being driven toward the developing roller 20D in contact with the periphery of the toner supply roller 22 is positively charged due to friction thereof with the roller 22. On reaching the developing roller 20D, the positively charged toner is more intensely charged by the roller 20D to the same polarity due to friction and, therefore, electrostatically deposited on the roller 20D. At this instant, the high and medium resistance bodies 32*r* and 34*r* have been negatively charged, but the amount of charge is greater on the former than on the latter due to the difference in resistivity, as shown in FIG. 34. Consequently, a difference is developed between the surface potentials of the resistance bodies 32r and 34r with the result that microfields are generated between them. Apparently, therefore, a positive charge is induced on the medium resistance bodies 34r. Since almost countless high and medium resistance bodies 32r and 34r are distributed alternately with each other on the periphery of the conductive base countless microfields are developed and uniformly distributed on the surface of the developing roller 20D. More specifically, electric lines of force and, therefore, microfields are formed in the space adjoining the surface of the roller 20D, as represented by arcuate lines in FIG. 34. The microfields cause a great amount of toner 16 to deposit on the roller 20D and to be transported by the latter to the developing region 28.

As stated above, only the high and medium resistance bodies 32r and 34r are exposed to the outside on the surface of the developing roller 20D, i.e., the conductive surface of the base 30 does not appear at all. The advantage attainable with this particular configuration is that the flow of charge between the belt 12 and the developing roller 20D is controlled to insure high quality image reproduction.

While the illustrative embodiment charges the high and medium resistance bodies 32r and 34r to the opposite polarity to the toner 16, the resistance bodies 32r and 34r both may be charged to the same polarity as the toner 16 so as to collect a great amount of toner especially on the resistance bodies 34r. Alternatively, an arrangement may be made such that only the high resistance bodies 32r are charged to the predetermined polarity with the medium resistance bodies 34r substantially not charged. The gist is that at least the high resistance bodies 32r are charged to generate the microfields due to the difference in surface potential.

Figure 35:
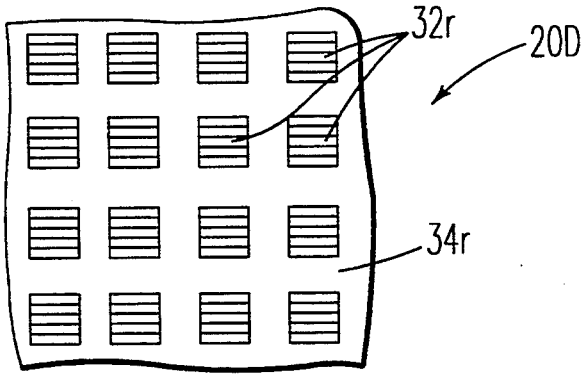
FIGS. 35 to 38 are views each showing a particular arrangement of the high and medium resistance bodies.
Figure 36:
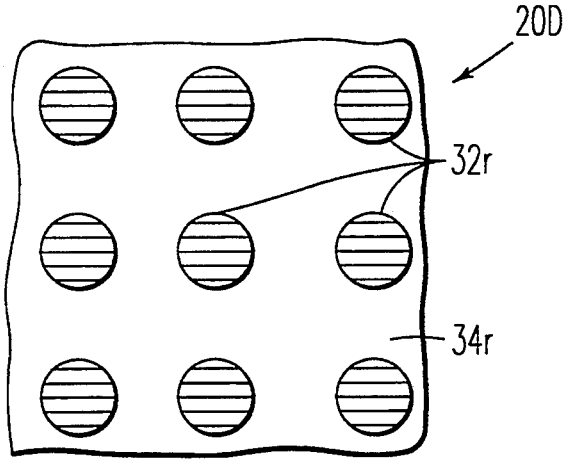
Figure 37:
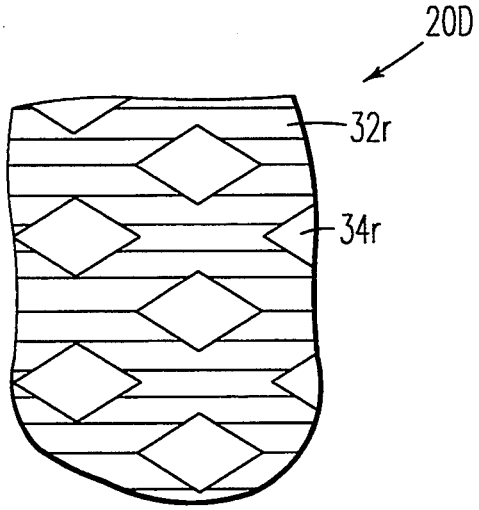
Figure 38:
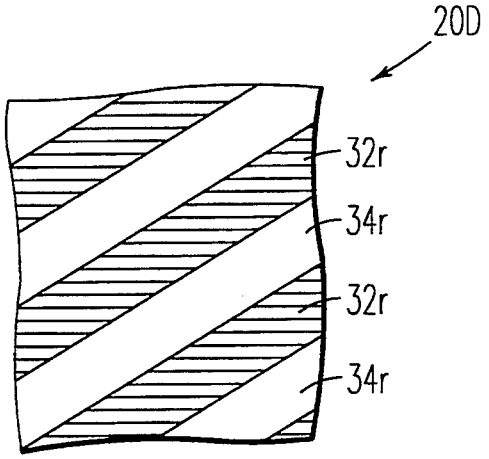

The layout of the medium and high resistance bodies 34r and 32r are open to choice as well as the surface configuration and size which have been stated earlier. For example, as shown in FIGS. 35 and 36, the high resistance bodies 32r each having a suitable surface configuration may be distributed in the medium resistance body 34r. Conversely, as shown in FIG. 37, the medium resistance bodies 34r each having a suitable surface configuration (diamond) may be distributed in the high resistance body 32r. Further, as shown in FIG. 38, the medium and high resistance bodies 34r and 32r may be elongate and alternate with each other. When each high resistance body 32r has a circular surface as shown in FIG. 36, its diameter is selected to be, for example, 30 to 500 μm, preferably 50 to 300 μm. When the high resistance bodies 32r are arranged in a stripe pattern as shown in FIG. 38, their width and distance are selected to range from 30 to 500 μm, for example.

The base for mounting the high and medium resistance bodies 32r and 34r may be implemented with a conductive member only the surface of which for carrying the resistance bodies is conductive. In such a case, the conductive layer will be connected to ground and applied with a predetermined bias voltage.

Fourth Embodiment

Figure 39:
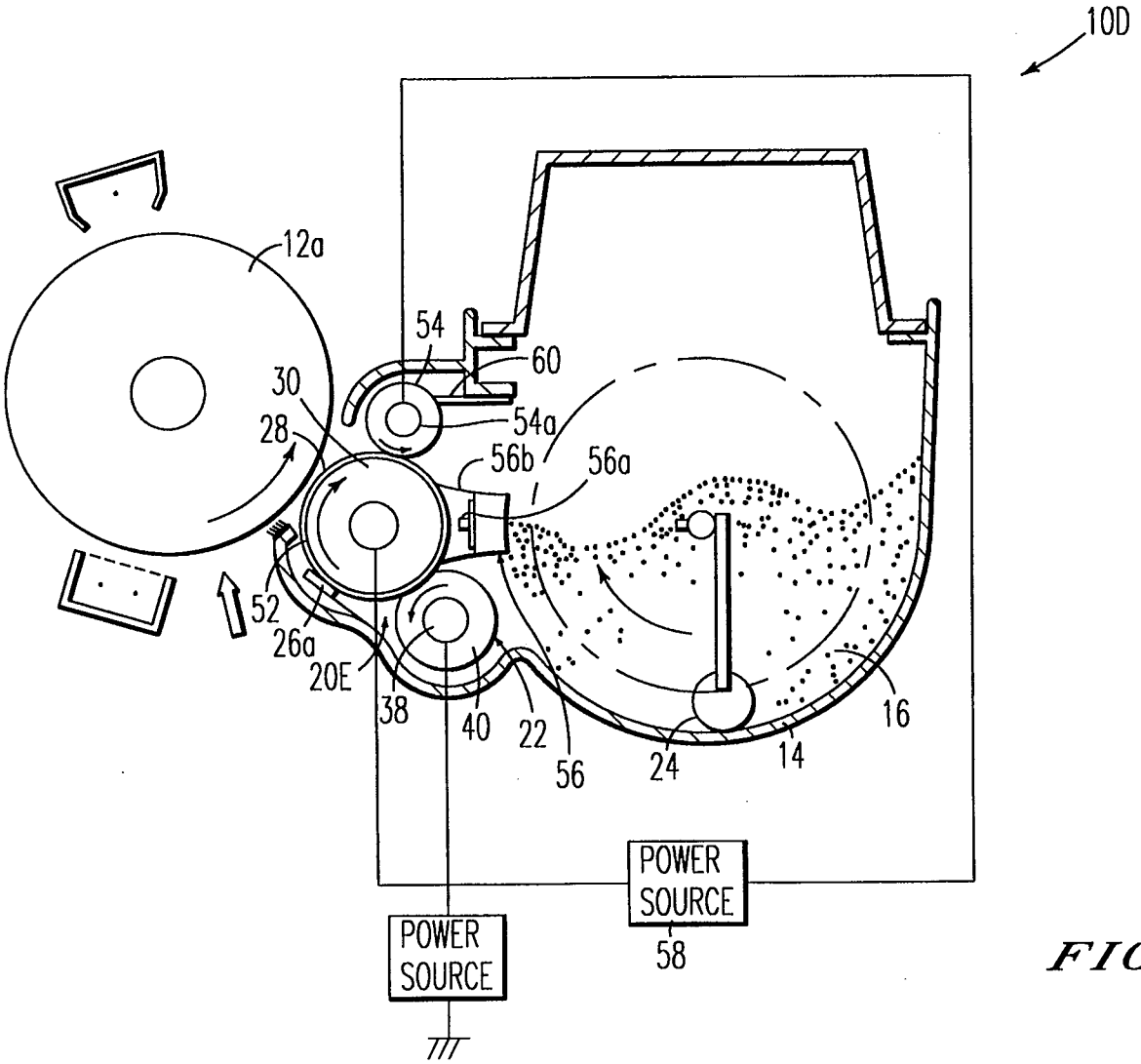
FIG. 39 is a section showing a fourth embodiment of the present invention.

FIG. 39 shows a fourth embodiment of the present invention which is an alternative implementation for forming the microfields. As shown, the developing device 10D is incorporated in an electrophotographic copier having a photoconductive drum 12a which is rotatable counterclockwise. A developing roller 20E is rotatable clockwise and carries thereon the one-component developer, or non-magnetic toner, 16 supplied thereto by the toner supply roller 22. The toner 16 on the developing roller 20E is regulated in thickness by a doctor blade 26a and then transported to the developing region 28 to effect non-contact development. Such a construction is essentially similar to the constructions of the previous embodiments except for some differences. The fourth embodiment differs from the previous embodiments in that the developing roller 20E is made up of the conductive base 30 and a chargeable photoconductive layer 52 provided on the base 30, and in that charging means in the form of a roller 54 and a light source device 56 are provided. Specifically, the developing roller 20E has a structure similar to that of the photoconductive drum 12a. The charging roller 54 may be implemented by a sponge roller having a conductive core 54a and a conductive foamed body constituted by foaming urethane rubber and affixed to the periphery of the core 54a. Alternatively, the roller 54 may be comprised of a brush roller having a core 54a and filaments of a dispersion of a conductive substance in polyester, Teflon or similar material. The charging roller 54 contacts the periphery of the developing roller 20E and is rotated counterclockwise, for example. A power source 58 applies a voltage opposite in polarity to the toner 16 to the charging roller 54.

The surface portion of the developing roller 20E moved away from the developing region 28 frictionally contacts the charging roller 54 with the result that the toner 16 remaining on the former is removed by the latter. At the same time, the surface of the photoconductive layer 52 of the developing roller 20E is charged to the opposite polarity to the toner 16 due to the charge injected by the charging roller 54 in the dark or due to the discharge occurring between the layer 54 and the roller 52. The toner 16 removed from the developing roller 20E is scraped off the charging roller 54 by a scraper 60 and then used again. Assuming that the toner 16 is positively charged, the surface potential of the charged developing roller 20E ranges, for example, from −50 to −500 V, preferably from −100 to −300 V, so that the operating voltage of the power source 58 is −300 V to −2000 V, preferably −500 to −1000 V. The power source 58 may be implemented with DC or AC-superposed DC.

The light source device 56 is made up of a number of fine point light sources such as an LED (Light Emitting Element) array 56a and a pair of screening plates 56b which prevent light issuing from the light sources 56a from leaking to the outside. When the surface portion of the developing roller 20E having been charged as stated above reaches the light source device 56, the LED array 56a flashes to illuminate the surface of the roller 20E in a fine dot pattern. As a result, the surface potential of the developing roller 20E is lowered in the illuminated portions and substantially not lowered in the other portions. In this manner, the light source device 56 selectively illuminates the surface of the developing roller 20E to produce numerous fine charged portions and numerous fine non-charged portions. Consequently, a great number of microfields are developed in the vicinity of the surface of the developing roller 20E, as in the previous embodiments. It is to be noted that all the operations described so far are effected in the dark except for the illumination by the light source device 56, and that the surface portions of the developing roller 20E not illuminated by the LED array 56*a* is insulative. On the other hand, when the toner 16 charged by the toner supply roller 22 to the positive polarity, for example, reaches the surface of the developing roller 20E, it is firmly deposited on the roller 20E in a great amount by the above-mentioned microfields. The so sufficiently charged toner 16 is transported to the developing region 28 by the developing roller 20E. This is also successful in producing a high quality image with a predetermined. density. In addition, since the developing roller 20E can be rotated at a linear velocity close to that of the drum 12*a*, there is eliminated the occurrence that the density of at solid image formed on the drum 12 becomes unusually high only in a trailing edge portion thereof with respect to the rotating direction of the drum 12*a*.

The charging roller 54 shown in FIG. 39 may be replaced with any other suitable charging means so long as it is capable of depositing a charge on the surface of the developing roller 20E. For example, use may be made of a corona discharger for charging the roller surface to a predetermined polarity. Alternatively, a blade or a roller may be used which charges the developing roller 20E by friction.

Figure 40:
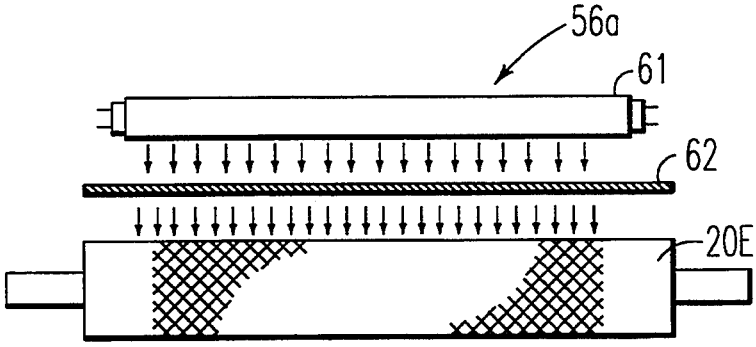
FIGS. 40 and 41 are views each showing another specific construction of a light source device included in the developing device of FIG. 39.

Of course, the light source 56 is not limited to the LED array 56*a*. FIG. 40 shows an alternative light source 56A consisting of a cold cathode tube 61 and a transparent film 62. The cold cathode tube 61 is located to face the developing roller 20E. The transparent film 62 is interposed between the tube 61 and the roller 20E and loaded with a fine pattern which does not transmit light, e.g. a zigzag pattern. Light issuing from the cold cathode tube or light source 61 selectively illuminates the surface of the developing roller 20E through the film 62 on the basis of the pattern provided on the film 62, whereby numerous microfields are developed. Double-hatching shown in FIG. 40 is representative of the selective charging of the roller surface.

Figure 41:
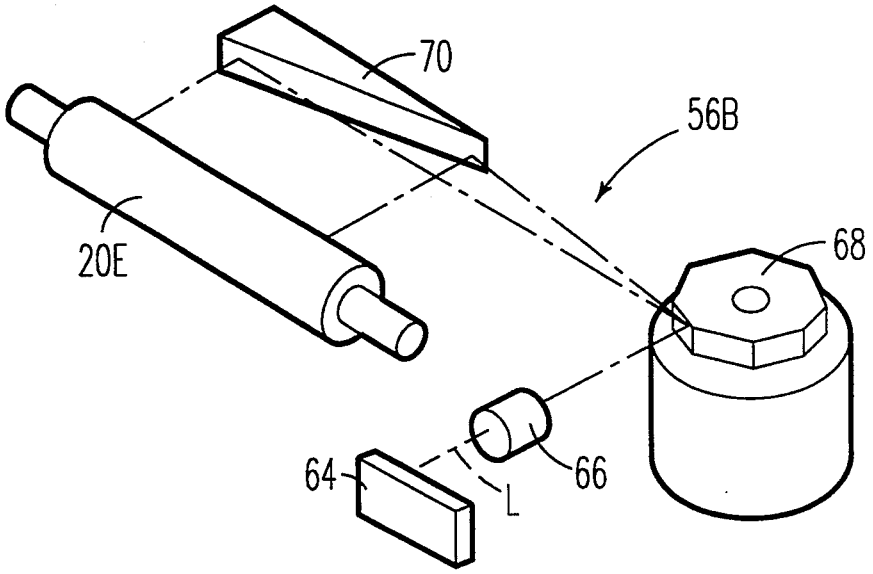

FIG. 41 shows another alternative light source device 56B which uses a light source 64 in the form of a semiconductor laser. A laser beam L issuing from the light source 64 is provided with a predetermined diameter by a collimator lens 66, then reflected by a polygonal mirror 68 which is driven in a rotary motion, and then reflected by a prism or similar reflector 70 to scan the surface of the developing roller 20E. The laser beam L from the light source 64 has been so modulated as to irradiate the surface of the developing roller 20E in a dot pattern. As a result, the charged surface of the developing roller 20E is selectively deposited with numerous charges, so that numerous microfields are developed.

The chargeable photoconductive layer 52 provided on the developing roller 20E may be formed of any suitable substance so long as it is usable as a photoconductive element for electrophotography. For example, such a substance may be selected from inorganic photoconductive substances based on Se, Pb, Cd, Zn and Si and their compounds which are or are not dispersed in a binding material, organic photoconductive substances based on carbocyclic compounds, heterocyclic compounds, pigments, azos, phthalocyanines, and allylamine/allylmethanes, and polyvinyl carbazole-based or similar polymeric photoconductive substances, either singly or in combination. Amorphous silicon-based substances are desirable from the wear resistance standpoint, while organic photoconductors and zinc oxide which is a dispersed inorganic photoconductor are preferable from the cost performance standpoint.

Fifth Embodiment

Figure 42:
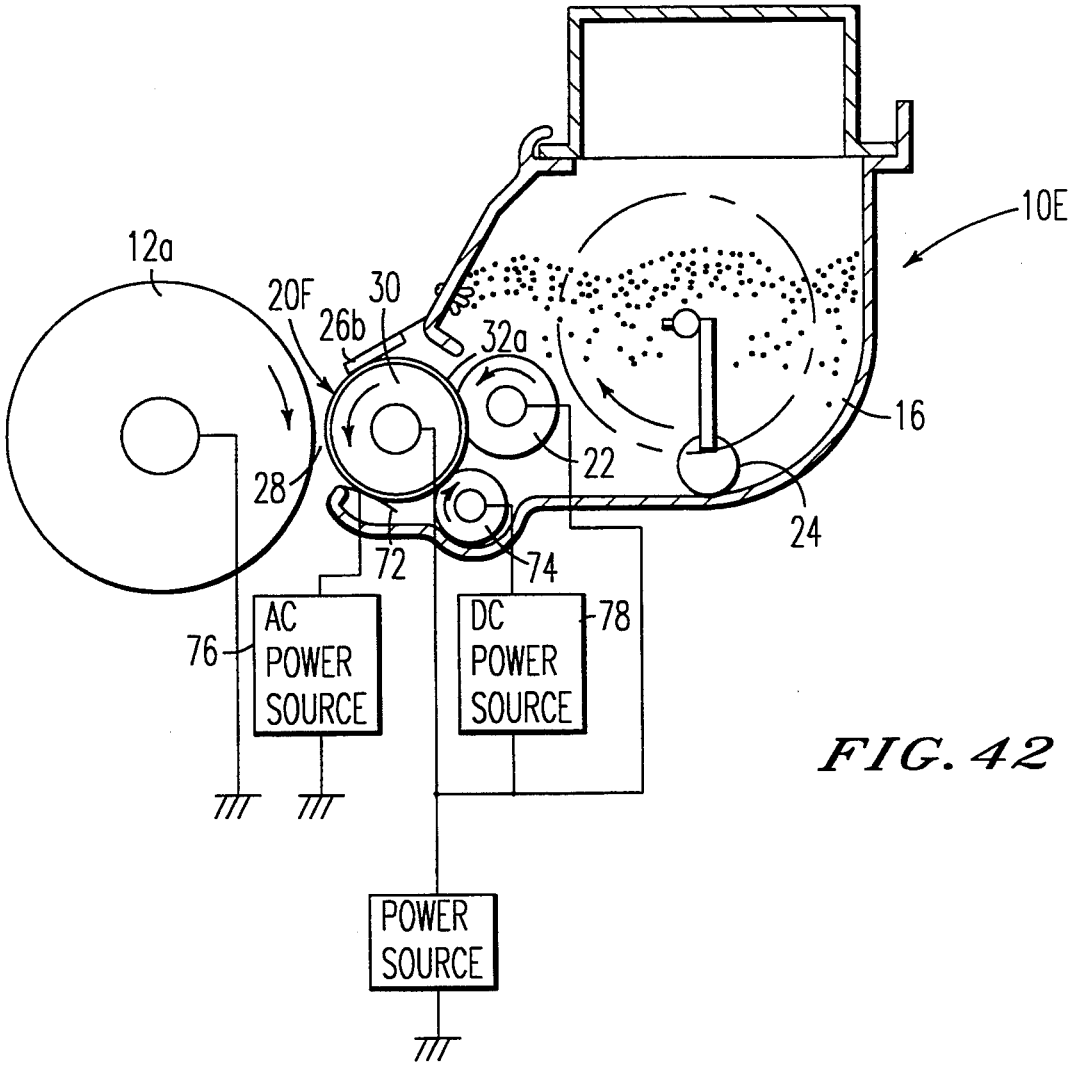
FIG. 42 is a section showing a fifth embodiment of the present invention.
Figure 43:
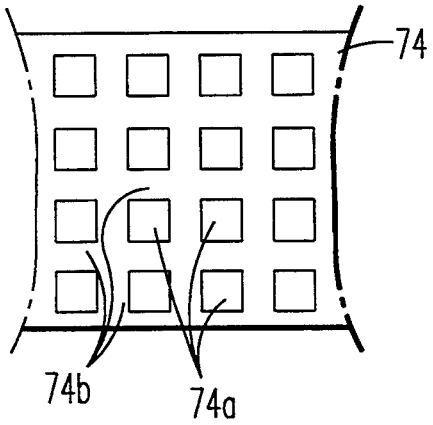
FIG. 43 is a view showing the surface of a charging roller included in the fifth embodiment.

FIG. 42 shows a fifth embodiment of the present invention, i.e. a developing device 10E. As shown, in the developing device 10E, the drum 12*a* and a developing roller 20F are individually rotated in the opposite directions to the drum and roller shown in FIG. 39. The non-magnetic toner 16 fed to the developing roller 20F by the toner supply roller 22 is regulated by the doctor blade 26*b* and then develops a latent image brought to the developing region 28. This embodiment is essentially similar to the fourth embodiment except that the developing roller 20F has a dielectric body 32*a* covering the entire surface of the conductive base 30 in a ladder, and that discharging means and charging means in the form of a conductive blade 72 and a roller 74, respectively, are arranged in this order upstream of the toner supply roller 22 and downstream of the developing region with respect to the rotating direction of the developing roller 20F. The discharging blade 72 contacts the developing roller 20F and applied with an AC voltage by an AC power source 76 so as to discharge the surface of the roller 20F moved away from the developing region 28 and to scrape off the remaining toner. The charging roller 74 also contacts the developing roller 20F and rotates at the same linear velocity and in the same direction as the roller 20F as seen in a position where they contact each other. The charging roller 74 is made of aluminum, copper, iron or similar conductive metal. As shown in FIG. 43 in an enlarged scale, the surface of the roller 74 is knurled or otherwise machined to have grooves 74*a* each being 100 to 500 μm deep, preferably 200 μm deep, and 100 to 500 μm wide, preferably 200 μm wide. The distance between nearby grooves 74*a* is preferably 200 μm. The grooves 74*a* and portions 74*b* without the grooves 74*b* form a great number of projections and recesses in cooperation. A voltage opposite in polarity to the charge of the toner 16 is applied to the charging roller 74 by a DC power source 78. In this embodiment, the toner 16 is also assumed to be positively charged, and the charging roller 74 is held at a potential of −250 V, for example.

In the developing device 10E having the above construction, as the developing roller 20F reaches the charging roller 74, only the projections 74*b* on the surface of the roller 74 press themselves against the surface of the roller 20F by a suitable pressure. At this instant, charges are deposited only on the portions of the developing roller 20F that are in contact with the projections 74*b* of the charging roller 74 due to the injection of charges into the dielectric body 32*a* via the projections 74*b* or due to the discharge occurring therebetween. As a result, countless charges are deposited on the dielectric body 32*a* of the developing roller 20F, i.e., a fine pattern having charge potentials which are different by 250 V, for example, and having a distance of about 200 μm. This develops microfields between nearby portions of the surface of the developing roller 20F which have different charge potentials, as in the previous embodiments. Hence, the toner 16 charged by the friction of the toner supply roller 22 and the developing roller 20F is deposited firmly and in a great amount on the developing roller 20F by the microfields, thereby forming a high quality image with high density. The discharging blade 72 again discharges the surface of the developing roller 20F having moved away from the developing region 28, and then the charging roller 74 again charges the surface of the roller 20F.

Should the surface of the developing roller 20F have low resistance, the charge would be apt to leak and, therefore, would fail to maintain the small charges. In such a condition, the intensity of the micro fields and, therefore, the toner retaining force would be lowered. In the light of this, the specific volume resistivity of the dielectric body 32*a* of the developing roller 20F should preferably be selected to be higher than $10^3$ Ω·cm which allows a minimum of leak to occur. This is also true with the dielectric bodies 32 of the other embodiments.

While various embodiments of the present invention have been described above, the common point is that charges are selectively deposited on the surface of a developing roller to form a great number of microfields, thereby causing the roller to carry a great amount of toner thereon.

It is to be noted that the present invention is similarly applicable to the developing devices of various kinds of image forming equipment other than an electrophotographic copier.

In summary, it will be seen that the present invention provides a developing device which allows a developer carrier thereof to carry a great amount of one-component developer and thereby produces a high quality image with high density by a sufficiently charged non-magnetic toner. Extra charging means other than a developer supply member is not needed, so that the cost is cut down. Further, charges can be deposited on dielectric bodies of the developer carrier with unprecedented efficiency.

Various modifications will become possible for those skilled in the art after receiving the teachings of the present disclosure without departing from the scope thereof.

What is claimed is:

1. A developing device for developing a latent image electrostatically formed on an image carrier in a developing region to thereby produce a corresponding visible image, said device comprising;

a rotatable developer carrier for carrying a developer to the developing region, and causing said developer to deposit on the latent image, said developer carrier comprising a conductive base and a resistance body which is made of medium resistance bodies and high resistance bodies arranged on a surface of said conductive base, wherein said medium resistance bodies have a resistivity higher than a resistivity of said conductive base while said high resistance bodies have a resistivity higher than the resistivity of said medium resistance bodies; and charging means for forming small closed electric fields in the vicinity of said surface of said developer carrier;

said developer being deposited on said surface of said developer carrier by said small closed electric fields.

2. A developing device as claimed in claim 1, wherein at least said high resistance bodies are charged to selectively deposit a charge thereon to thereby form said small closed electric fields between said high resistance bodies and said medium resistance bodies.

3. A developing device as claimed in claim 1, wherein said high resistance bodies and said medium resistance bodies are arranged in a regular pattern.

4. A developing device as claimed in claim 1, wherein said high resistance bodies and said medium resistance bodies are arranged in an irregular pattern.

5. A developing device as claimed in claim 1, wherein said high resistance bodies have a resistivity of $10^9$ to $10^{15}$ Ωcm, while said medium resistance bodies have a resistivity of $10^3$ to $10^8$ Ωcm.

6. A developing device for developing a latent image electrostatically formed on an image carrier in a developing region to thereby produce a corresponding visible image, said device comprising;

a developer carrier for carrying a developer supplied thereto on a surface thereof, conveying said developer to the developing region, and causing said developer to deposit on the latent image; and charging means for forming small closed electric fields in the vicinity of said surface of said developer carrier;

said developer carrier comprising a conductive base, and dielectric bodies fixedly buried in recesses formed in said conductive base;

said dielectric bodies each having a predetermined cross section, which extends in a direction of a line normal to said surface of said developer carrier.

7. A developing device as claimed in claim 6, wherein said surface of said developer carrier has a plurality of surface portions arranged in a predetermined pattern, each of said surface portions having a particular characteristic, and wherein small closed electric fields are formed on said surface portions by depositing a charge on at least one of said surface portions whereby a charged developer is carried on said surface portions by use of said small closed electric fields.

8. A developing device as claimed in claim 7, wherein said charge is deposited on said at least one of said surface portions by charging said at least one of said surface portions by means of said charging means.

9. A developing device as claimed in claim 8, wherein said dielectric bodies are charged by said charging means to selectively deposit a charge on said surface portions.

10. A developing device as claimed in claim 9, wherein said small closed electric fields are formed between said dielectric bodies having a charge and said conductive base.

11. A developing device as claimed in claim 8, wherein said conductive base has conductive portions and said dielectric bodies have exposed portions, wherein each of said plurality of surface portions has a particular characteristic comprising said conductive portions of said conductive base and said exposed portions of said dielectric bodies, and wherein at least said exposed portions of said dielectric bodies are charged by said charging means to selectively deposit a charge on said surface portions.

12. A developing device as claimed in claim 11, wherein said small closed electric fields are formed between said exposed portions of said dielectric bodies having a charge and said conductive portions of said conductive base.

13. A developing device as claimed in claim 11, wherein said conductive portions of said conductive base and said exposed portions of said dielectric bodies are arranged in a regular pattern.

14. A developing device as claimed in claim 11, wherein said conductive portions of said conductive base and said exposed portions of said dielectric bodies are arranged in an irregular pattern.

15. A developing device an claimed in claim 8, wherein said charging means comprises a developer supply member which contacts said plurality of surface portions to charge said at least one of said surface portions each having a particular characteristic and to supply the developer to said surface portions of said developer carrier.

16. A developing device as claimed in claim 15, wherein said charging means frictionally charges said at least one of said surface portions to deposit a charge thereon.

17. A developing device as claimed in claim 15, wherein said charging means comprises a frictionally charging roller held in contact with said surface portions of said developer carrier which is located downstream of the developing region and upstream of said developer supply member with respect to an intended direction of developer transport for frictionally charging said at least one of said surface portions of said developer carrier.

18. A developing device as claimed in claim 15, wherein said charging means comprises a frictionally charging blade held in contact with said surface portions of said developer carrier which is located downstream of developing region and upstream of said developer supply member with respect to an intended direction of developer transport for frictionally charging said at least one of said surface portions of said developer carrier.

19. A developing device as claimed in claim 6, wherein at least a part of said surface of said developer carrier has a charge retaining function and wherein said at least a part of said surface is charged to selectively deposit a charge on said surface to thereby form said small closed electric fields on said surface whereby a charged developer is carried on said surface.

20. A developing device as claimed in claim 6, wherein a surface of each of said dielectric bodies has a charge retaining function and wherein said surface of said dielectric body is charged to selectively deposit a charge on said surface to thereby form said small closed electric fields on said surface whereby a charged developer is carrier on said surface.

21. A developing device as claimed in claim 6, wherein said predetermined cross-section of said dielectric body is generally V-shaped.

22. A developing device an claimed in claim 6, wherein said predetermined cross-section of said dielectric body is generally U-shaped.

23. A developing device as claimed in claim 6, wherein said predetermined cross-section of said dielectric body is generally rectangular.

24. In a developing device for developing a latent image electrostatically formed on an image carrier by supplying a developer from a developer carrier to a developing region at which said developer carrier faces said image carrier, the improvement wherein said developing device comprises a charging means for charging a photoconductive surface of said developer carrier, and illuminating means for selectively illuminating the photoconductive surface to deposit a charge on said photoconductive surface to produce charged portions and non-charged portions on said photoconductive surface and thereby form a great number of microfields on said photoconductive surface whereby charged developer is carried on said photoconductive surface.

25. A developing device as claimed in claim 24, wherein said illuminating means comprises a light source device implemented with a great number of fine point light sources.

26. A developing device as claimed in claim 24, wherein said illuminating means comprises an array of a great number of light emitting diodes each being capable of flashing.

27. A developing device as claimed in claim 24, wherein said illuminating means comprises a cold cathode tube and a transparent film pattern, wherein light issuing from a light source thereon selectively illuminates the photoconductive surface through openings defined in the transparent film pattern.

* * * * *